US007191635B2

(12) United States Patent
Chun et al.

(10) Patent No.: US 7,191,635 B2
(45) Date of Patent: Mar. 20, 2007

(54) PRESS MOUNTED CAM

(75) Inventors: Victor L. Chun, Walton Hills, OH (US); Brian Russel, Sheridan, MI (US); Brian Lee Taylor, Medina, OH (US); Frank Madej, Mentor, OH (US)

(73) Assignee: Danly IEM, LLC, Boston, MA (US)

( * ) Notice: Subject to any disclaimer, the term of this patent is extended or adjusted under 35 U.S.C. 154(b) by 84 days.

(21) Appl. No.: 11/069,828

(22) Filed: Feb. 28, 2005

(65) Prior Publication Data

US 2006/0101894 A1 May 18, 2006

Related U.S. Application Data

(60) Provisional application No. 60/629,147, filed on Nov. 18, 2004.

(51) Int. Cl.
*B21D 5/04* (2006.01)
*B26D 5/16* (2006.01)

(52) U.S. Cl. ..... 72/452.9; 72/315; 72/304

(58) Field of Classification Search ..... 72/452.9, 72/304, 315, 381
See application file for complete search history.

(56) References Cited

U.S. PATENT DOCUMENTS 1,999,057 A 4/1935 Peterson et al.
5,101,705 A * 4/1992 Matsuoka ..... 72/452.9
5,231,907 A 8/1993 Matsuoka
5,269,167 A 12/1993 Gerhart
5,487,296 A 1/1996 Gerhart et al.
5,884,521 A * 3/1999 Fidziukiewicz ..... 72/452.9
5,904,064 A * 5/1999 Higuchi ..... 72/452.9
6,079,250 A 6/2000 Scannell (Continued)

FOREIGN PATENT DOCUMENTS

DE 19860178 C 5/2000

(Continued)

OTHER PUBLICATIONS

International Search Report for PCT Application PCT/US2005/34616, dated Sep. 21, 2006.

*Primary Examiner*—David Jones
(74) *Attorney, Agent, or Firm*—Schnader Harrison Segal & Lewis, LLC

(57) ABSTRACT

A press mounted cam has a slide guided on an adapter by structural features including as one or more T blocks fixed to the slide and received in a respective channel formed in the adapter. In an aerial cam embodiment, a vertical clearance space is provided between the T block and adapter channel such that positive driving engagement between cam surfaces on the slide and the adapter is momentarily delayed after the initial engagement of the slide and driver surfaces to let the momentum of the slide be absorbed prior to the beginning of positive driving by the press motion, reducing shock and noise. The slide is laterally located with respect to the driver by an upwardly projecting locator-guide key on the driver received in a central channel in the slide. A positive return is provided by engagement of a driver key having T features received in a T-shaped slide channel and captured therein when the slide is driven laterally. This engagement creates a positive return of the slide when the press upper platen is raised.

16 Claims, 26 Drawing Sheets

U.S. PATENT DOCUMENTS 6,164,115 A * 12/2000 Higuchi et al. ..... 72/452.9
6,196,040 B1 3/2001 Matsuoka
6,220,137 B1 4/2001 Matsuoka
6,336,399 B1 1/2002 Matsuoka
6,519,995 B2 2/2003 Matsuoka
6,619,095 B2 9/2003 Matsuoka
6,997,029 B2 2/2006 Chun et al.
7,043,956 B2 * 5/2006 Higuchi et al. ..... 72/452.9
2002/0152789 A1 10/2002 Matsuoka
2003/0213351 A1 11/2003 Matsuoka
2004/0144230 A1 7/2004 Oshita

FOREIGN PATENT DOCUMENTS

EP 0586725 A 3/1994
JP 58 003733 A 1/1983

* cited by examiner

PRESS MOUNTED CAM

CROSS REFERENCE TO RELATED APPLICATION

This application claims the benefit of U.S. provisional Ser. No. 60/629,147, filed Nov. 18, 2004.

BACKGROUND OF THE INVENTION

This invention concerns press mounted cams, which are mechanisms installed in forming presses to produce a feature on a workpiece being formed within the press by die having an upper part installed on an upper platen of the press and a lower die part installed on a lower press platen. The cam is used to form a punched or tapped hole where the feature is located such that it must be formed by tool motion along a direction at a working angle across the direction of press movement. The press mounted cams are used to produce such crossing tool motion.

These cams are comprised of a "slide", carrying the tool, a "body" or "adapter" affixed to one of the die parts or press platens on which the slide is slidably mounted, and a separate "driver" mounted on the other of the die parts or press platen. The driver engages the slide and drives the same by engagement of cam surfaces when the press is operated.

In an "aerial" cam shown in FIG. 1, a slide 12 is suspended on a body or adapter 10 either directly mounted to the upper platen 2 or more typically to an upper part 6 of a forming die. A driver 14 is likewise either directly mounted to the lower platen 4 or more typically to a lower part 8 of a forming die and has fixed inclined cam surfaces 16 extending parallel to the working angle, typically defined by wear plates affixed to parallel faces on the driver 14 and slide 12.

As the upper platen 2 descends, a resulting cam action causes the slide 12 to be advanced along the working angle against the resistance of one or more springs 15, with tooling T projecting from the slide 12 driven in that direction. The horizontal component of the motion requires that the working slide 12 also move laterally on the adapter 10. Engaged horizontal bearing surfaces 18, 19 are provided on the top of the slide 12 and the bottom of the adapter 10 respectively for this purpose. In other configurations, an angled surface may be on the adapter, and a horizontal surface on the driver as in the embodiment seen in FIG. 12.

In a "die mounted" cam (shown in FIG. 2) the slide 12 and adapter 10 are both mounted to the lower platen 4 (or die part 8) which does not move, but rather the driver 14 is mounted to the moving upper platen 2 (or die part 6) and descends with the press upper platen 2 to engage the slide 12.

The die mounted cam thus does not result in vertical movement of the relatively heavy slide 12 with the upper platen 2, as occurs in an aerial cams. This vertical movement of the slide can cause problems as described below, but aerial cams are often used nonetheless since they create a clearance space to allow transfer of the workpieces into and out of the die and press.

In either cam mount design, in order to accurately locate the tooling T with respect to the workpiece W, the slide 12 must be accurately located laterally when being driven, and to achieve this, the practice heretofore has been to form the lower cam surfaces 16A in a V-shape so as to provide a lateral location of the slide on the driver as well as a camming surface as the slide 12 engages the driver 14 as seen in FIGS. 3 and 4.

Additional flat surfaces 16B are sometimes required for larger sized cams to provide adequate area to distribute the stresses imposed on the slider 12 by the press. Precision machining of the V-shaped surfaces is difficult and adds substantially to the cost of making the slide 12 and driver 14.

The slide 12 is suspended on the adapter 10 by means of side plates 20 engaged with hook over plates 22 attached to the sides of the slide 12. The slide 12 is guided along the plates 20, 22 when being advanced by the camming action on the slide 12 caused by the descent of the press upper platen.

The plates 22 are confined between side walls 24 to be laterally guided. A vertical hooked bar 26 is mounted on each side to reinforce the fixing of the plates 20.

Particularly in larger sizes, the need to machine features on the adapter 10 and slide 12 at locations on the outside of these components requires the use of large size machining centers, adding to substantially to the manufacturing costs.

In aerial cams, due to the large mass of the slider 12, an auxiliary roller cam 28 is provided to initiate and assist cammed lateral slide motion by engagement with a machined slot 30 on the driver 14, just prior to engagement of the cam surfaces. This helps to assist in redirection of the motion of slide 12 laterally to reduce peak stresses and consequent noise, shock, and wear of the cam surfaces. However, the roller cam 28 also adds substantially to the cost of such aerial cams.

A positive retraction auxiliary cam comprised of cam bars 32 and 34 is also provided to insure return movement of the slide 14 if return springs 38 in pockets 36 should fail due to excessive shock loading or are unable to withdraw the tool for some other reason such as a severely jammed tool.

The retraction cam bars 32, 34 are located at the outboard ends of the slide 12 and driver 14 and thus are difficult to machine especially in the larger cam sizes as described above. Also, the area of engagement therebetween is limited to the stroke of the slide 10, and the bars 32, 34 are subject to failure since a large force may be necessary to retract the slide 12 if a tool is severely hung up.

It is an object of the present invention to provide aerial cams which impose less shock on the mating components and to eliminate the need for auxiliary roller cams.

It is a further object to eliminate difficult to machine retention and locating features in both aerial and die mounted cams.

It is a further object to provide a more robust and durable positive retraction mechanism for both aerial and die mount cams.

SUMMARY OF THE INVENTION

The above objects and other objects which will become apparent upon a reading of the following specification and claims are achieved by suspending the slide on the adapter by structural features establishing a predetermined clearance space which must be taken up before the press can act to cam the slide laterally to be driven along its working angle. This momentarily delays the driving engagement of cam surfaces by the press until some brief time interval after initial contact of the slide with the driver has occurred. This allows the downward momentum of the slide to first be absorbed by the driver before the slide is forcibly cammed along the working angle by the press motion to reduce noise and the peak loading imposed on the slide-driver mating surfaces.

The slide is preferably suspended on the adapter using one or more T blocks fixed to the slide and captured in corresponding T channel slots at an inboard location on the adapter with a head portion of the T blocks resting on surfaces on each side of the slots. The use of inboard located T blocks eliminates the outboard located retention plates on the sides of the slide previously used.

The T blocks and channels may comprise the structural features mentioned above establishing a predetermined clearance space between the adapter and slide mating bearing surfaces so that when the slide first contacts the driver, the clearance space must first be taken up before the press motion itself will cause camming of the slide laterally. The presence of this clearance momentarily delays the driving engagement between the adapter and slide mating bearing surfaces until the clearance space is taken up. Auxiliary roller cams are thus not necessary.

In both aerial and die mounted cams, one or more in board locator-guide key projects from the driver and moves into a guide slot in the slide for lateral location and guidance as the slide cam surfaces approaches engagement with the inclined cam surface of the driver. These are much easier to machine laterally locator-guide surfaces. The inboard locator-guide key also eliminates the need for the precision machining of guide surfaces on the ends of the slide.

Also, in both aerial and die mount cams, a positive retraction mechanism may be incorporated, using a pair of spaced apart T heads affixed to the driver locator-guide key and moving into a mating T channel formed in the slide when engaging the slide through respective spaced apart openings in the T channel and captured as the slide is advanced along the stroke. This effectively doubles the length of mating engagement surfaces on the driver and slide when a positive retraction is necessitated to substantially increase the forces able to be exerted to positively retract the slide.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
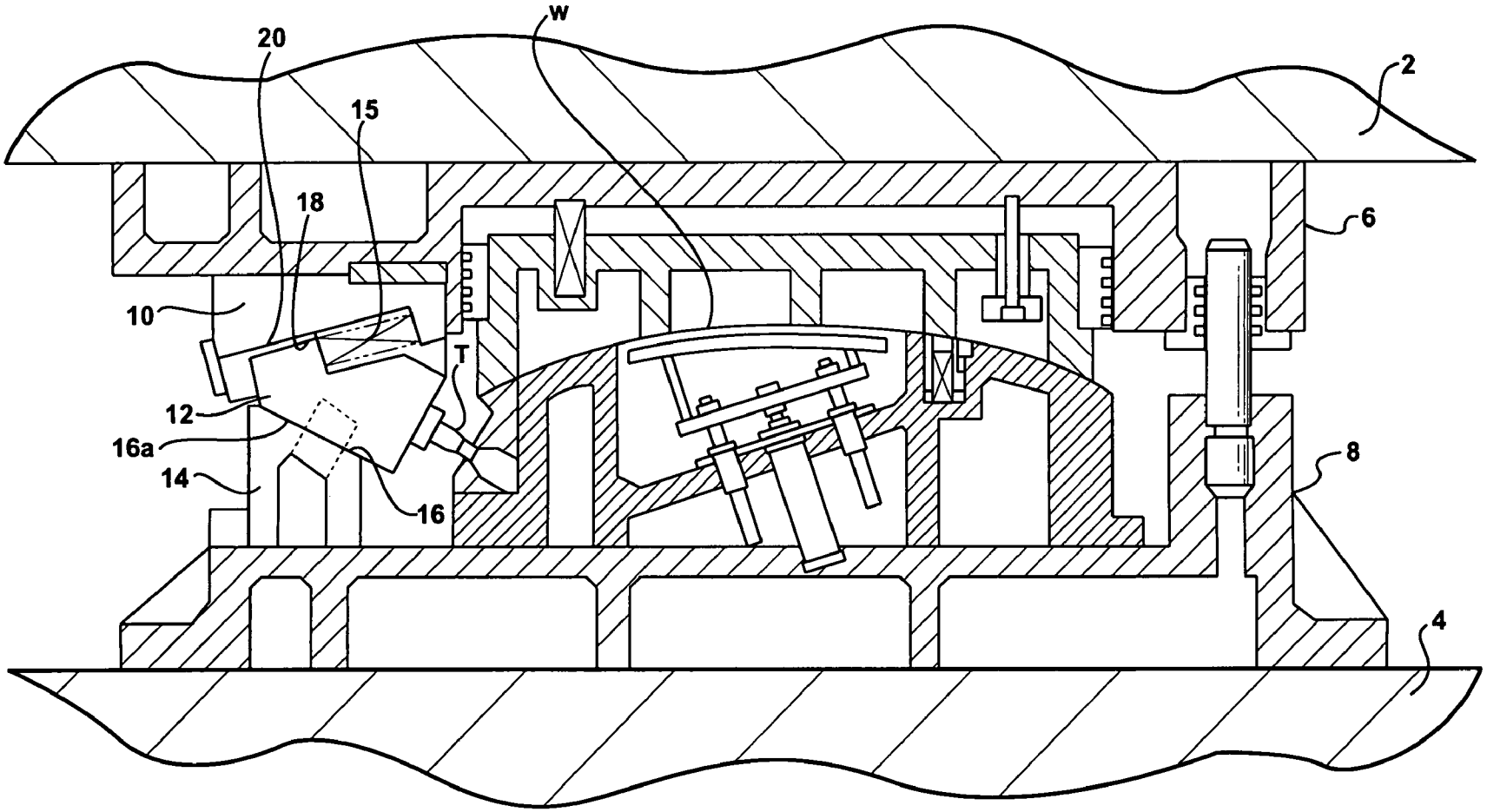
FIG. 1 is a partially sectional elevational view of a typical aerial cam and die parts installed in a press, shown in fragmentary form.
Figure 2:
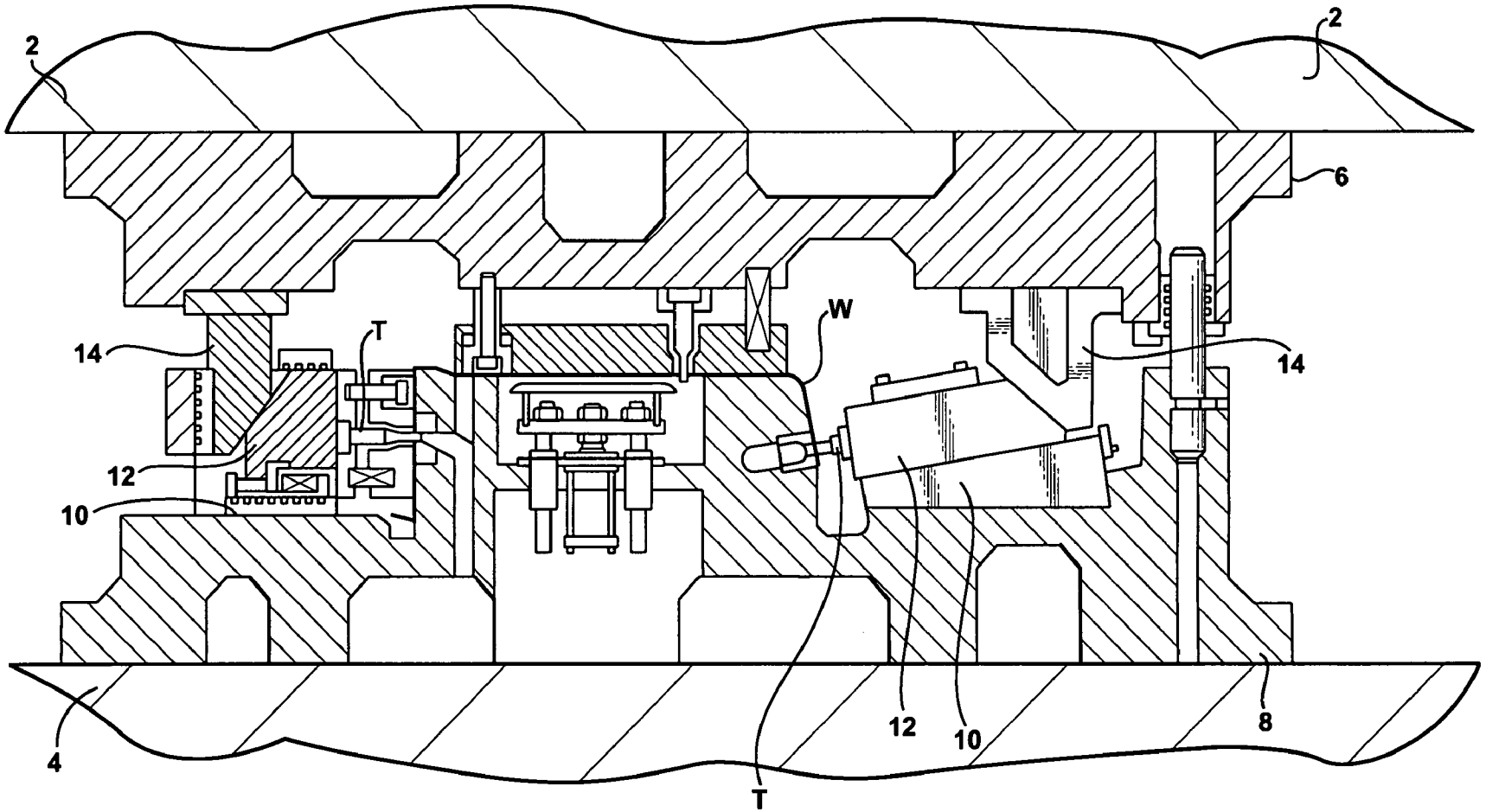
FIG. 2 is a similar view of a die mounted cam installed in a press.
Figure 3:
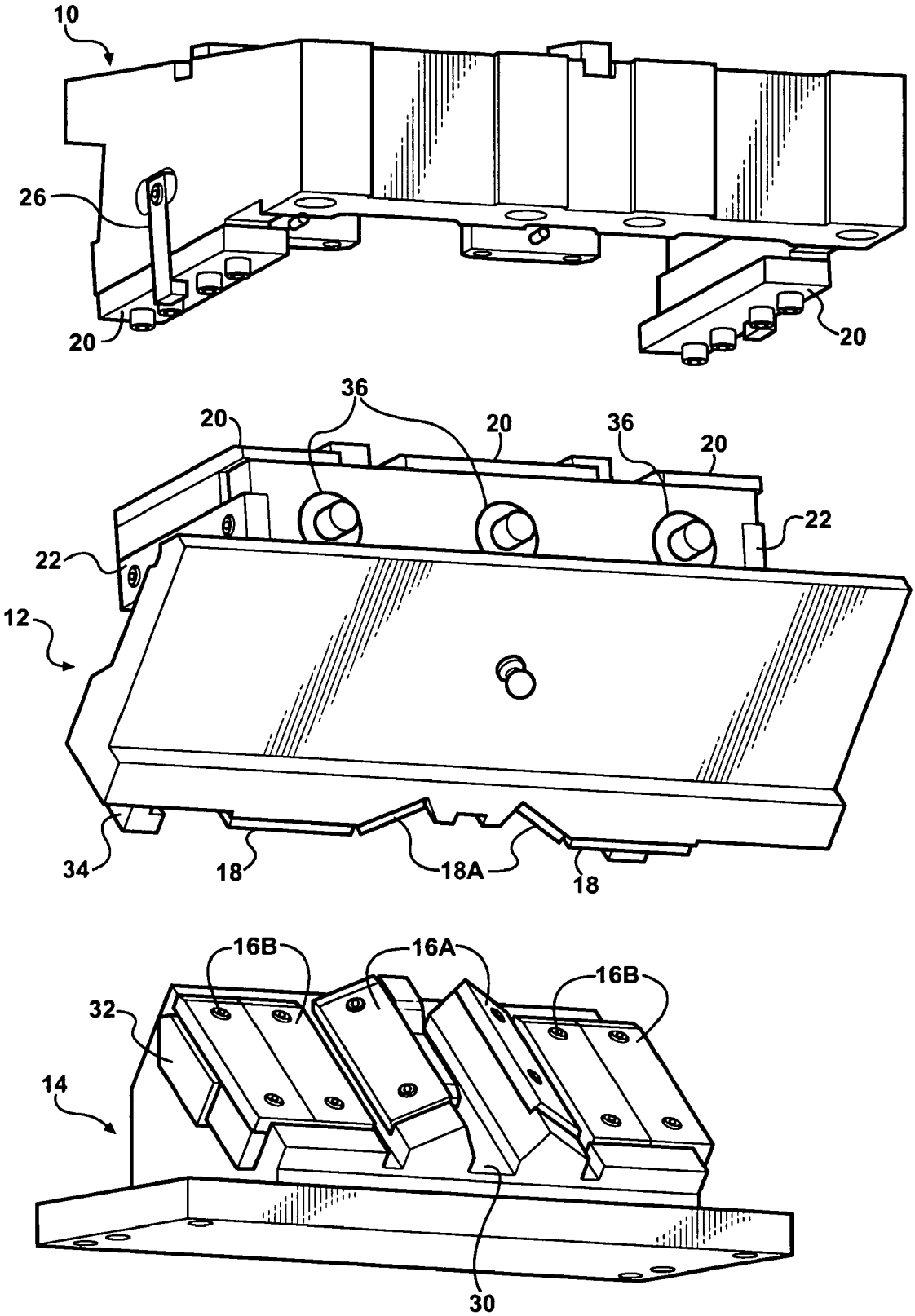
FIG - 3 PRIOR ART
FIG. 3 is an exploded pictorial view of an aerial cam of a prior design.
Figure 4:
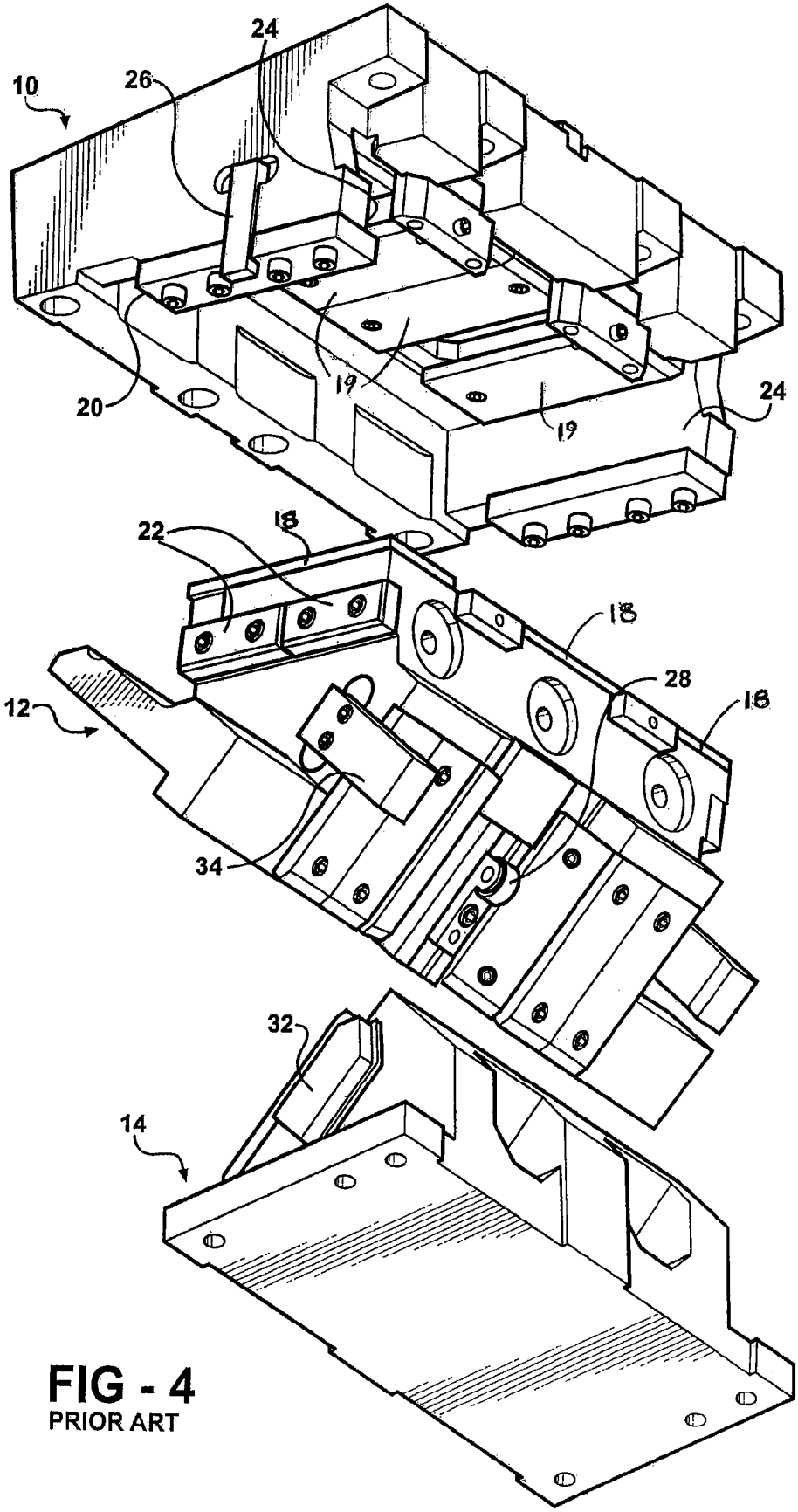
FIG - 4 PRIOR ART
FIG. 4 is a pictorial exploded reverse view of the prior aerial cam shown in FIG. 3.
Figure 5:
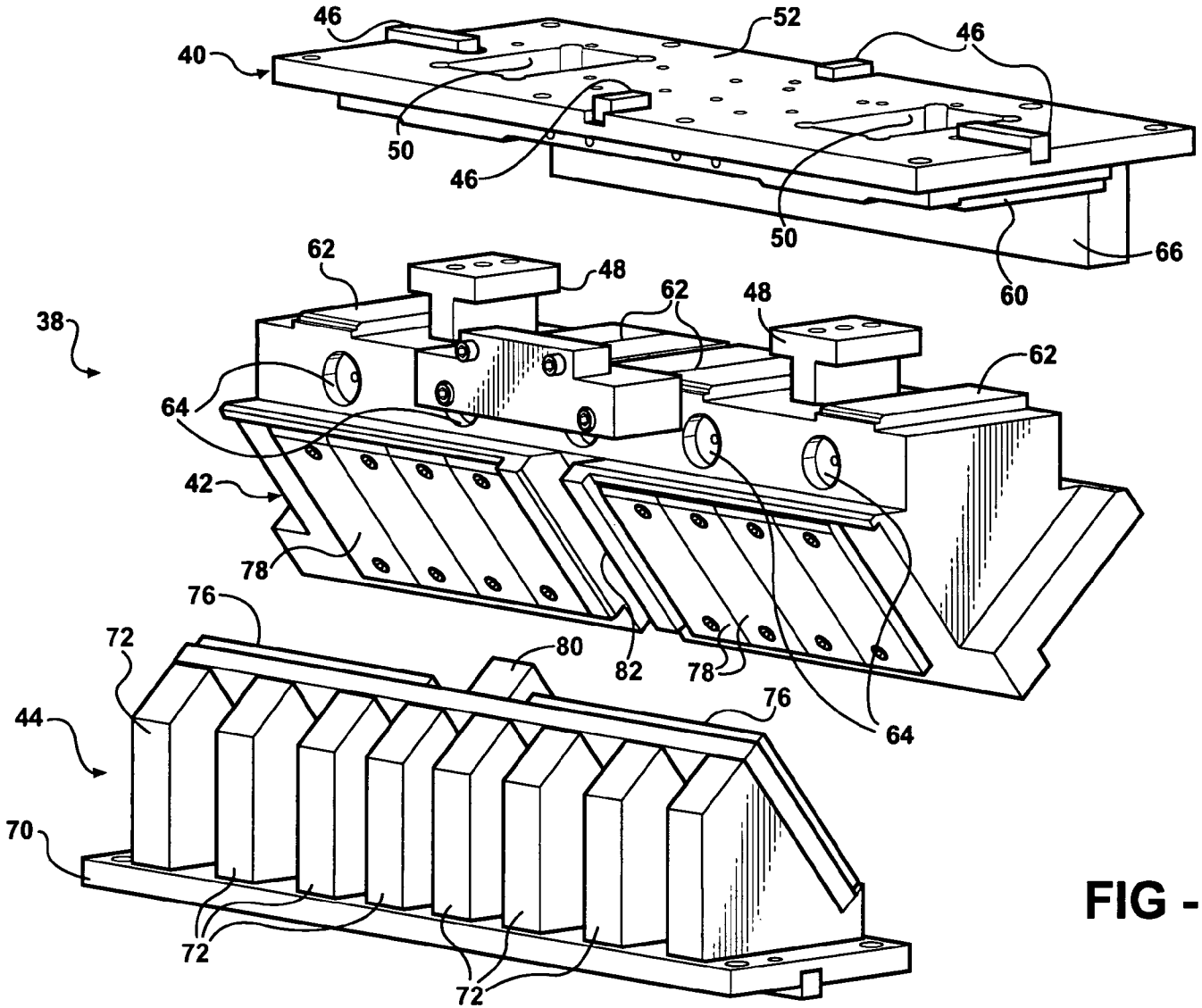
FIG. 5 is an exploded pictorial view of an aerial cam according to the present invention.
Figure 6:
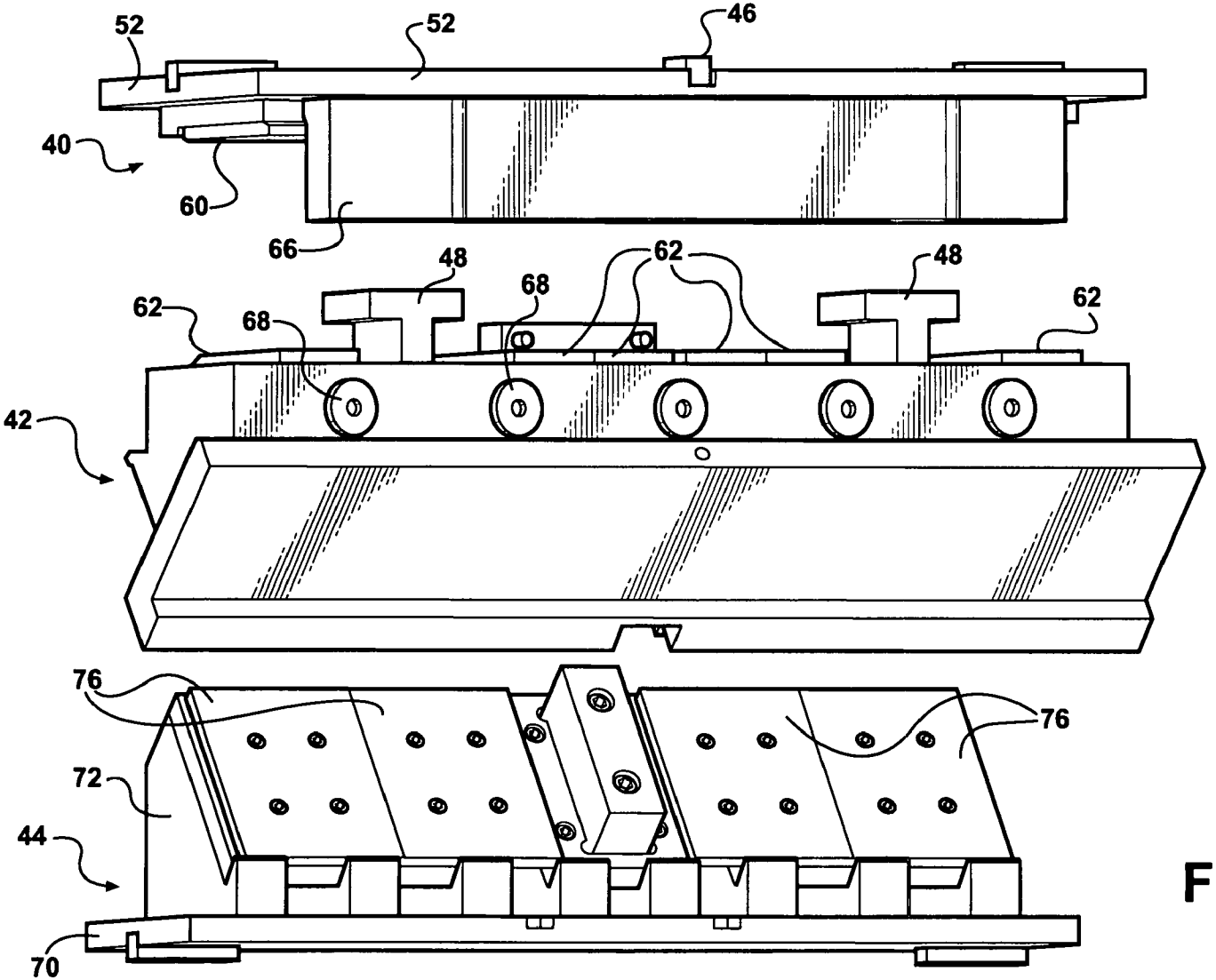
FIG. 6 is an exploded reverse pictorial view of the aerial cam shown in FIG. 5.
Figure 7:
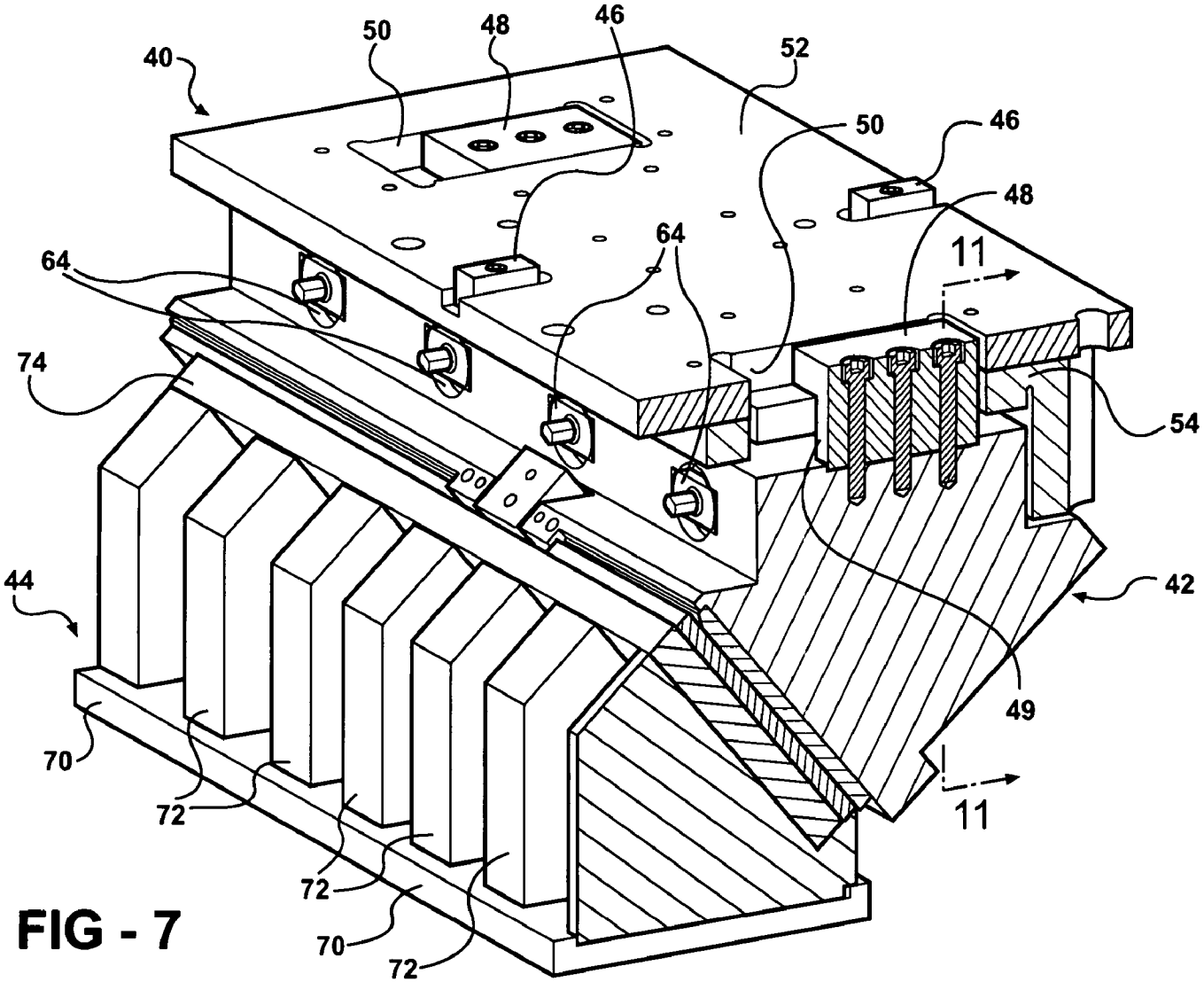
FIG. 7 is a pictorial partially sectioned view of the aerial cam shown in FIGS. 5 and 6.

Referring to FIGS. 5–7, an aerial cam 38 according to the present invention includes an adapter 40, a slide 42, and a driver 44.

The adapter 40 is affixed to an upper die part or press upper platen (neither shown) using keys 46 to be accurately and securely positioned thereon.

The driver 44 is mounted to a lower die part or directly to a press lower platen (neither shown) with upper surfaces of wear plates 76 and lower surfaces of wear plates 78 aligned to become engaged upon continued descent of the upper platen.

Figure 11:
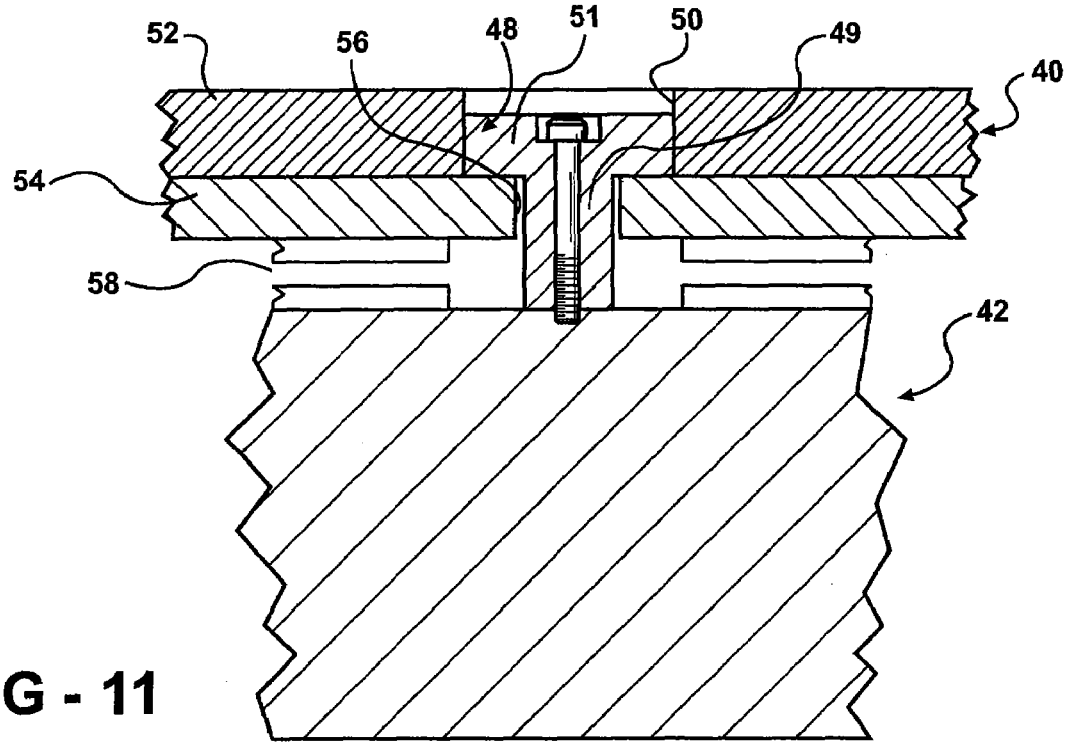
FIGS. 11 and 12 are enlarged fragmentary sectional views showing the relationship of T blocks and channel block supporting and guiding the slide on the adapter as the press is cycled with an exaggerated illustration of the clearance spaces used to effect a delay in positive engagement between the driver and slide.
Figure 12:
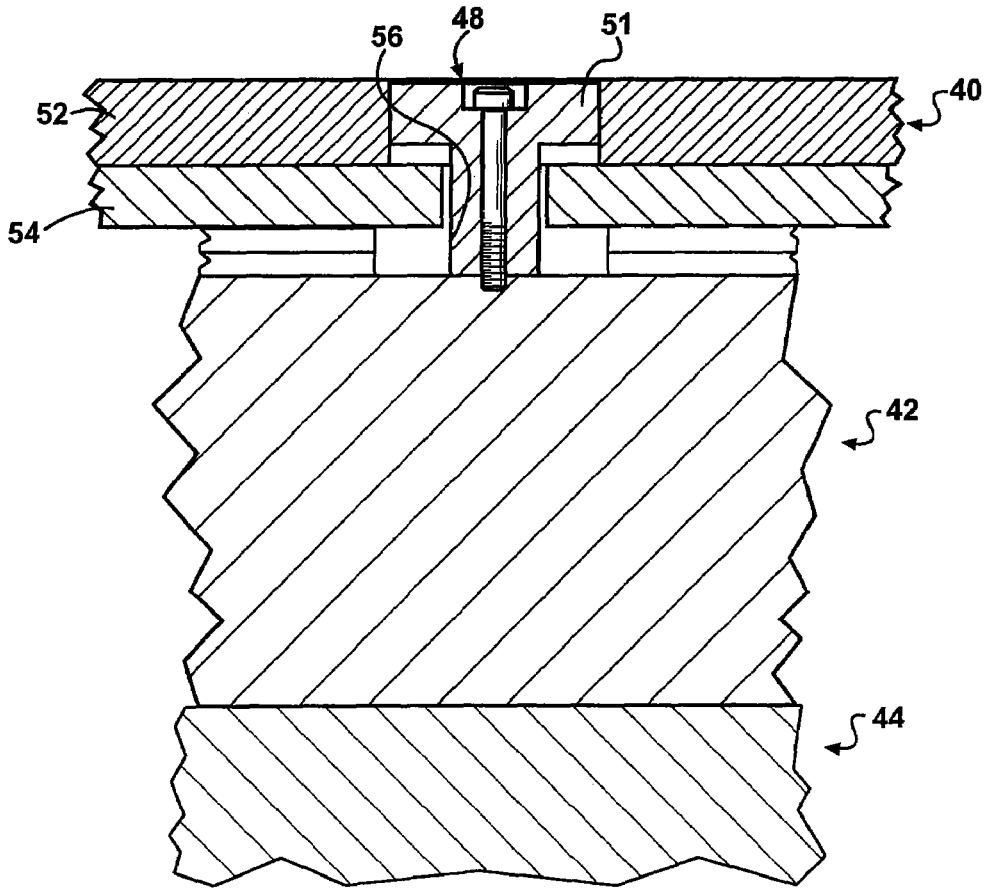
Figure 13:
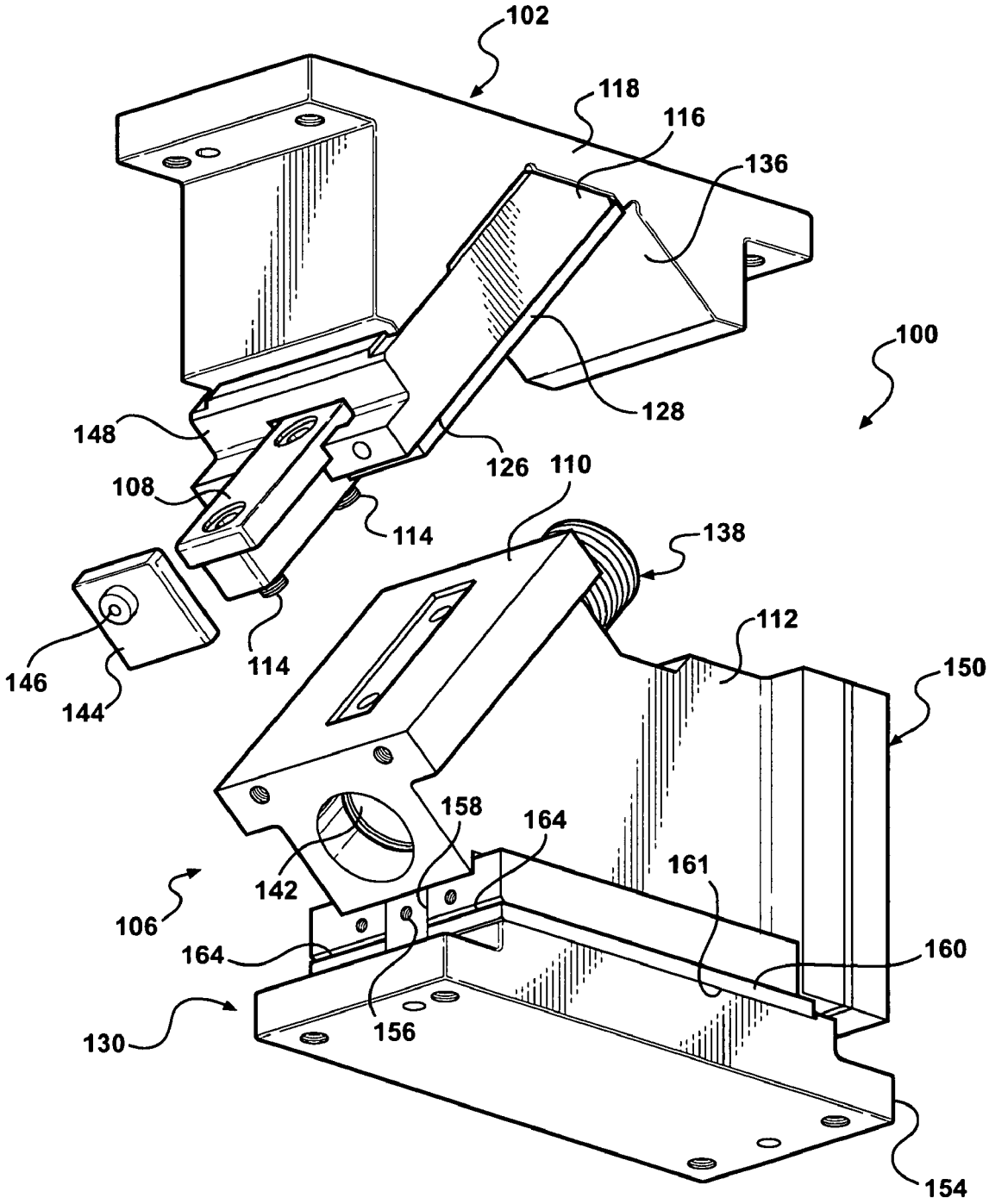
FIG. 13 is a partially exploded view of a second embodiment of an aerial cam according to the present invention.

The slide 42 is suspended on the adapter 40 by a pair of inboard located T blocks 48 affixed to the upper side of the slide, and passing through complementary slots or channels 50 in a base plate 52 of the adapter 40. As seen in FIGS. 7, 11 and 12, the base plate 52 has an underplate 54 affixed thereto, with slots 56 formed therein freely receiving the narrow lower part 49 of a respective T block 48, the head portion 51 resting on surfaces adjacent the respective slot 56.

A predetermined clearance space 58 (FIGS. 8A and 11) exists between the mating bearing surfaces on slide 42 and adapter 40 when the slide 42 is suspended from the adapter 40, but is taken up after a momentary delay when the press motion causes the initial engagement of the slide 42 with the driver 44 as described below. The clearance space 58 is shown greatly exaggerated and can be relatively slight, i.e., a space on the order of 0.001–0.002 inches would normally be sufficient. Thereafter, the press motion causes forcible engagement of the various mating surfaces to drive the slide 12 along the working angle.

Figure 8A:
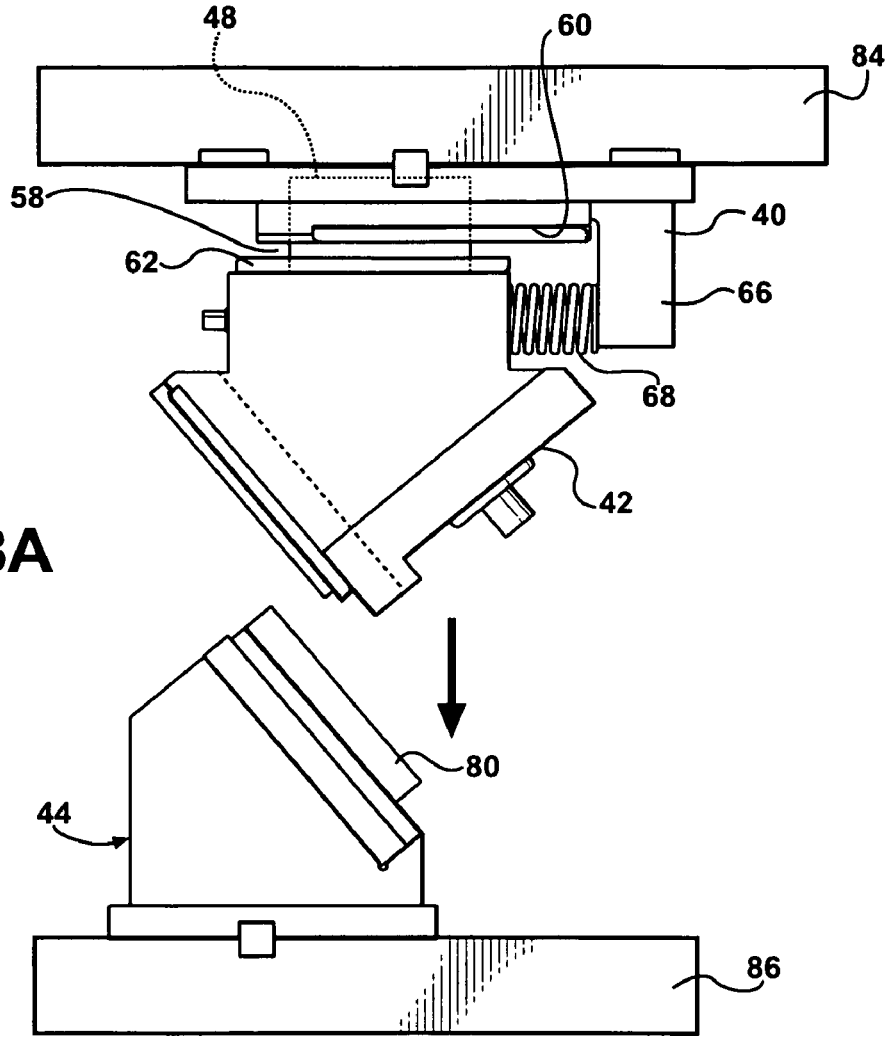
FIGS. 8A–8D are reduced size simplified views of an aerial cam according to the invention, showing successive stages in the work cycle.
Figure 8B:
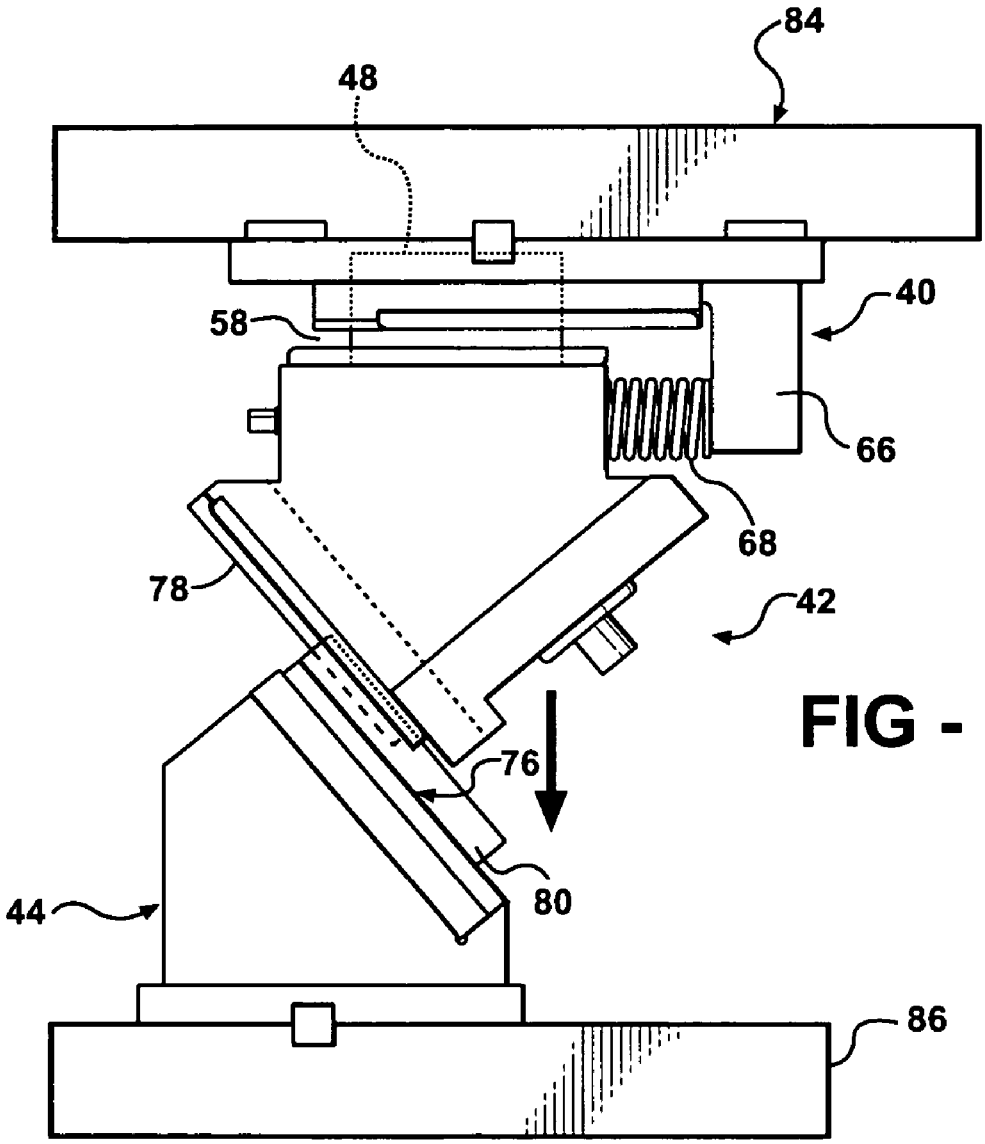
Figure 8C:
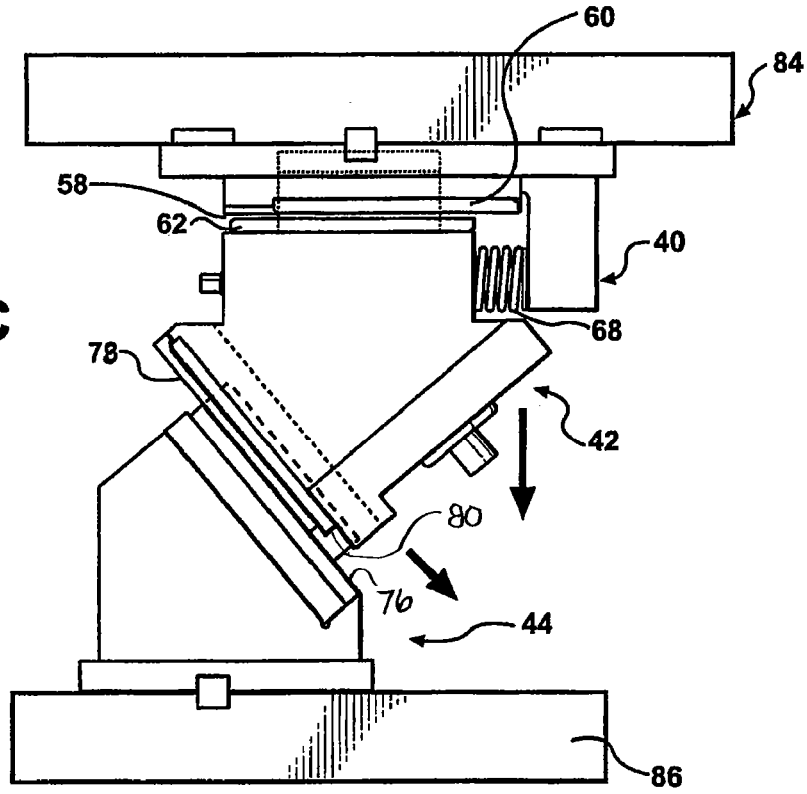
Figure 8D:
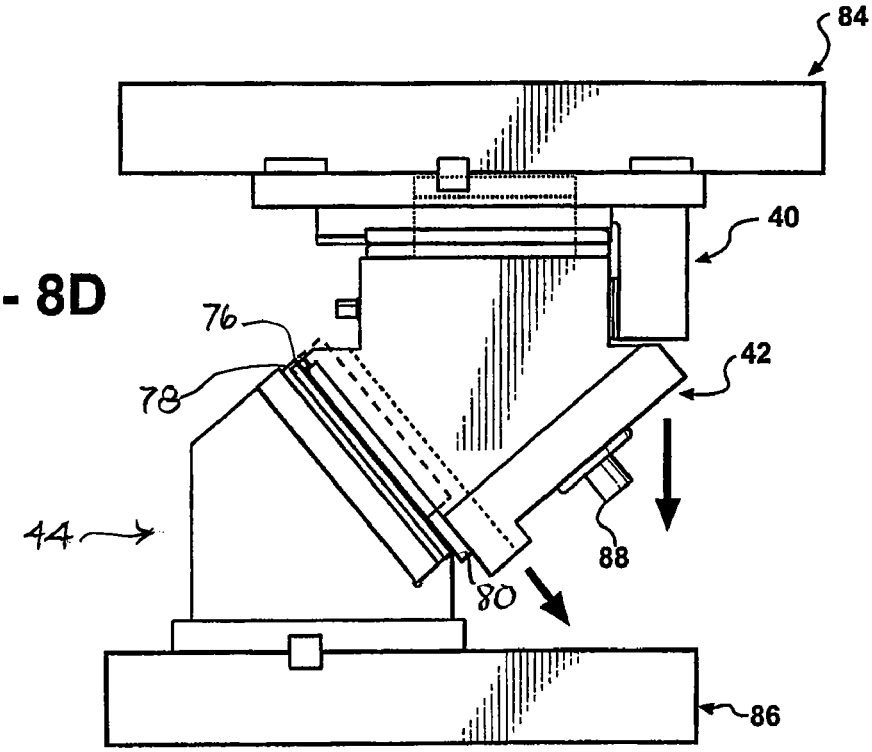

The slide 42 moves laterally on the adapter 40 in the embodiment shown in FIGS. 5–7 when the slide 42 is shifted by engagement with the driver 44 as the upper press platen descends as seen in FIGS. 8B–8D.

A set of wear plates 60 mounted on the surface of the adapter 40 rides on a mating set of wear plates 62 on the upper side of the slide 42.

As will be discussed below, the angle of the engagement surface on the adapter 40 changes with the angle of the driver 44 since the included working angle of the slide 42 typically remains constant with changes in the working angle. Thus, the wear plates and the surfaces on the adapter 40 will be inclined down from horizontal as the working angle becomes shallower.

The lateral component of the motion of the slide 42 relative the adapter 40 proceeds against the resistance of a series of compression springs 68 in pockets 64 formed in the slide 42, the springs 68 projecting out against end wall 66 of the adapter 40.

A closure lock as described in copending U.S. application Ser. No. 10/954,960, filed on Sep. 29, 2004 may be employed particularly if nitrogen springs are used.

A combination mechanical spring may be used instead of nitrogen springs as described in U.S. application Ser. No. 10/936,213, filed on Sep. 7, 2004.

The driver 44 is preferably of a segmented built up construction comprised of a flat base plate 70, having a side by side series of parallel upright flat plates 72 affixed to the upper surface. The length and working angles are easily varied by changing the configuration and number of plates 72 and the size of the base plate 70. This is much cheaper than producing a new casting for each configuration particularly considering that a separate mold for each configuration is necessary as described in copending application Ser. No. 11/060,082, filed on Feb. 16, 2005 and issued as U.S. Pat. No. 7,080,542

A support plate 74 is affixed to the upright plates 72 held at the working angle by the angled upper ends of the upright plates 72.

Cam wear plates 76 are secured to the support plate 74.

The inclined lower side of the slide 42 is provided with mating cam wear plates 78.

An upwardly projecting central locator-guide key 80 is affixed to the driver 44, aligned with a central slot 82 in the lower side of the slide 42.

The locator key 80 is placed and configured to move into the slot 82 as the upper platen lowers the slide 42 into engagement with the driver 44 but before engagement of the cam wear plates 76, 78. This laterally locates the slide 42 and guides it after the slide 42 is advanced along the working angle by the platen motion and engagement of the cam wear plates 76, 78.

FIGS. 8A–8D, and 11, illustrate the successive stages of movement of the first embodiment of the aerial cam according to the invention.

In the initial condition shown in FIGS. 8A, the slide 42 is suspended below the adapter 40 by the T blocks 48 and channels 50, with the predetermined clearance space 58 therebetween.

As the upper platen 84 descends towards the lower platen 86, the locator key 80 enters the slot 82 to provide lateral location and guidance, as seen in FIG. 8B.

The clearance space 58 is then still present, and the surfaces of the wear plates 76, 78 have not yet engaged.

Continued descent of the upper platen 84 brings the surfaces of the wear plates 76, 78 into initial contact as seen in FIG. 8C. The clearance space 58 still exists, although now being reduced.

This initial contact of the wear plates 76, 78 allows the downward momentum of the slide 44 to be absorbed by driver 44 and redirected to cause lateral motion of the slide 42 to be initiated as suggested by the partial compression of the springs 68 shown.

It should be noted that the extent of this motion and the size of the clearance space 58 is shown in an exaggerated form in order to be readily visible in the drawings.

Figure 9:
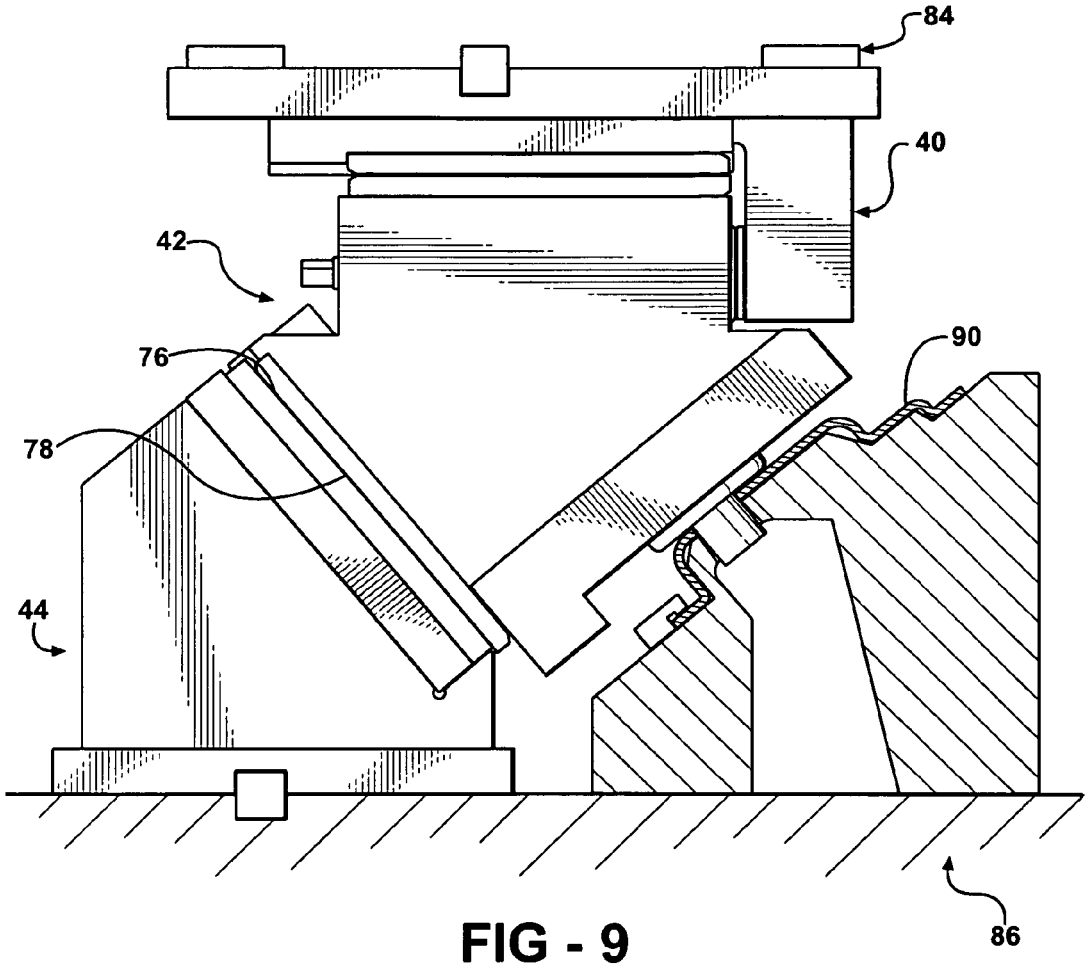
FIG. 9 is a diagrammatic view of the aerial cam shown in FIGS. 8A–8D, in the fully advanced position.

In the next stage, shown in FIGS. 8D and 12, the clearance space 58 has now been completely taken up, and the press upper platen 84 forcibly causes continued camming advance of the slide 42 laterally along the working angle. This drives the tooling 88 into contact with a workpiece W, fully compressing the springs 68 in the advanced position, as indicated diagrammatically in FIG. 9.

Thus, in the initial engagement of the wear plates 76, 78 only the downward momentum of the slide 42 is absorbed by the driver 44, and the positive press drive is momentarily delayed until the clearance space 58 is taken up. This reduces shock and noise, and obviates the need for auxiliary cam rollers, formerly used.

Figure 10:
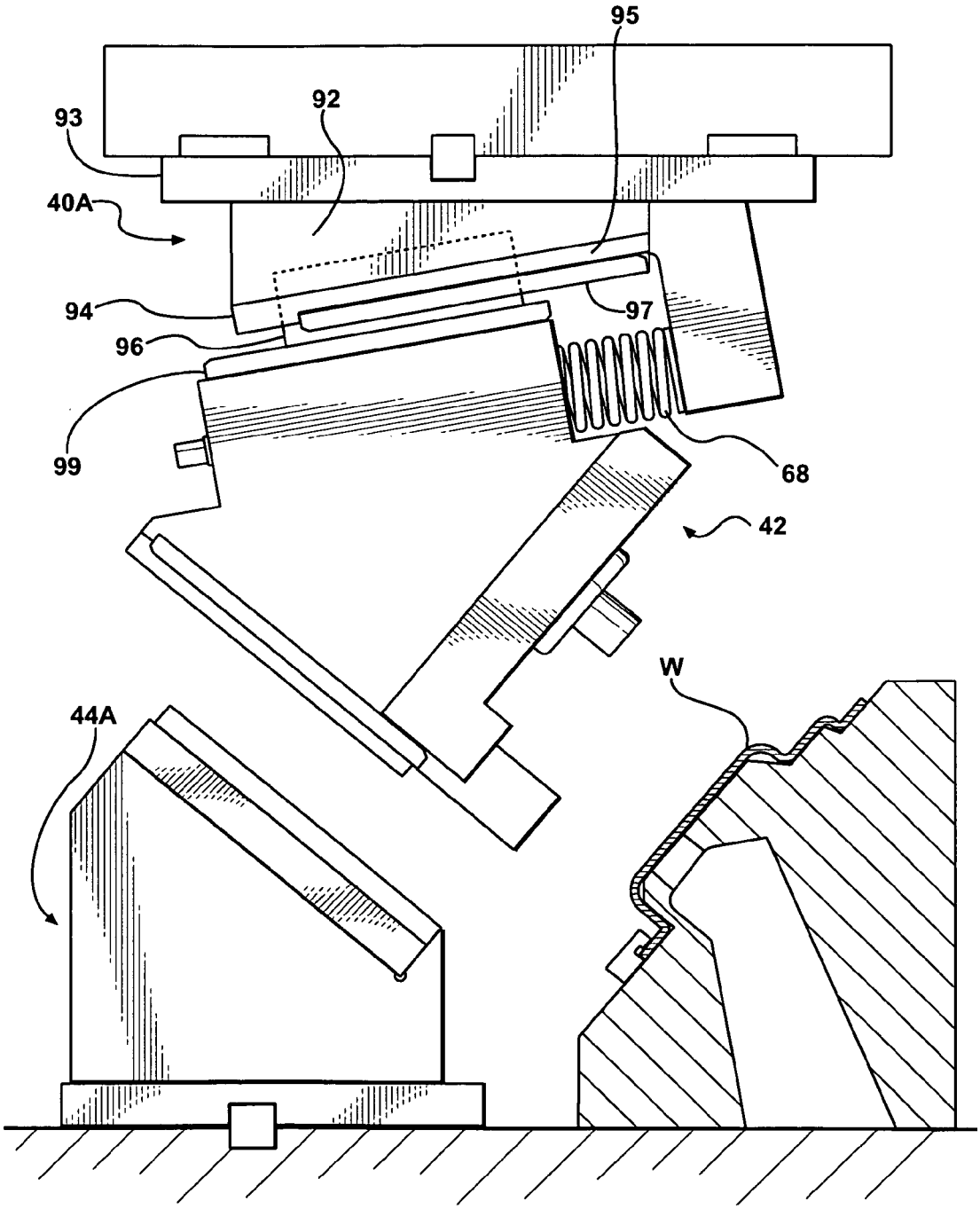
FIG. 10 is a side elevational view in partial section of another configuration of an aerial cam according to the present invention of the configuration.

As noted, if the working angle is shallower, the adapter 40 will have an inclined surface on which the wear plates are mounted as seen in another embodiment shown in FIG. 10.

In this case, the adapter 40A may also be constructed using a parallel series of plates 92 each mounted to a base plate 93 cut at an angle to incline base plate 93, in similar fashion to the driver 44A. The T block 96 passes through a slot in the support plate 94 and has wings which ride on the upper surface 95 of the support plate 96. The same initial clearance between wear plates 97, 99 is provided as indicated.

Referring to FIGS. 13–15 and 16A, 16B, 16C, a second embodiment of a simpler aerial cam 100 according to the invention is shown, of a much smaller size.

In this embodiment, the driver 130 has a horizontal slide surface and the adapter 102 is formed with a sloping cam surface engaging a complementary surface on the slide 106.

The adapter 102 is mounted on an upper platen 104 (FIGS. 16A–C) of a press. A slide 106 is suspended on the adapter 102 by means of a single centrally located T block 108 secured to an upper sloping surface 110 of a slide block 112 by screws 114.

Figure 16A:
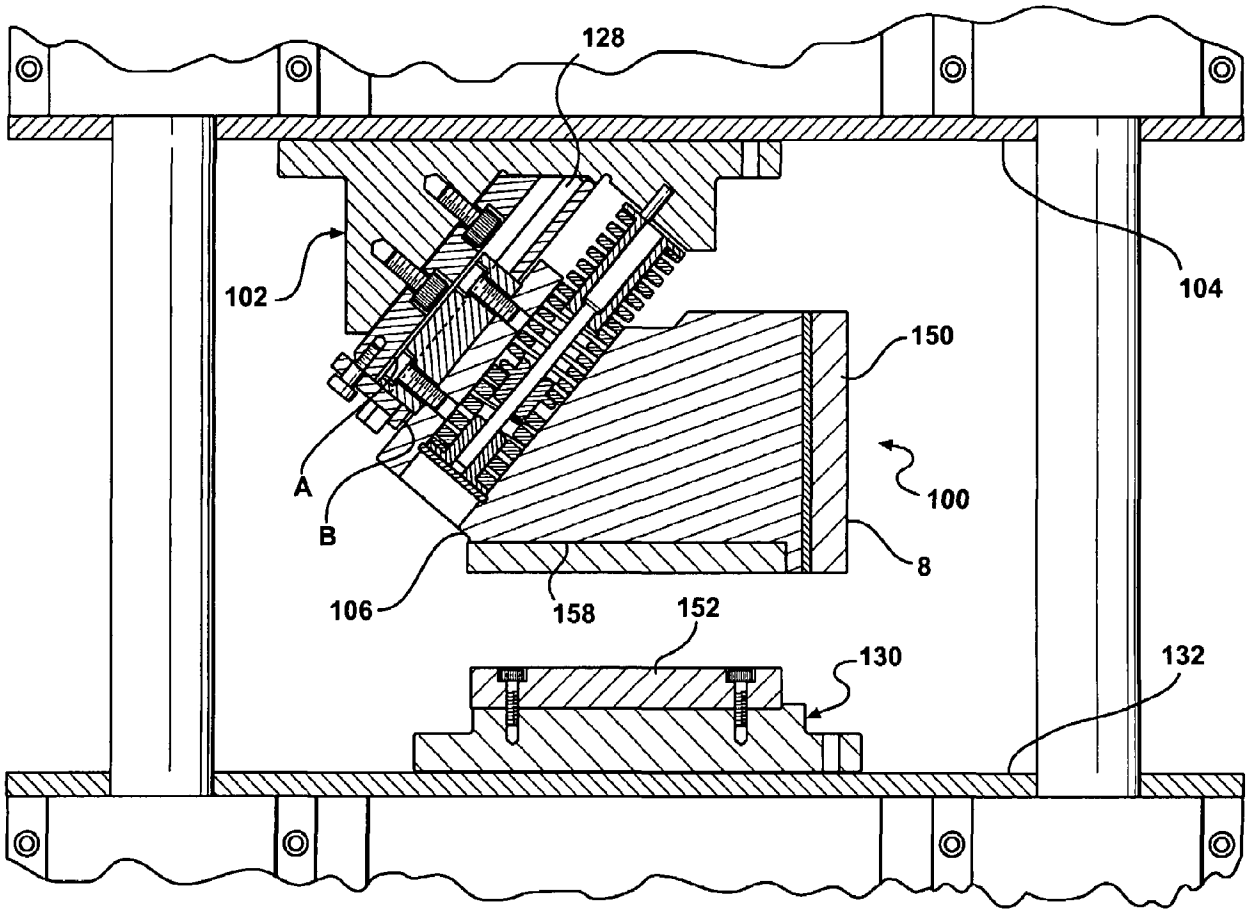
FIGS. 16A, 16B, and 16C are side elevational views of the second embodiment of an aerial cam shown in FIGS. 13–15 in partial section installed in a press, shown in fragmentary form, in successive positions occurring during operation of the press.

A T guide 116 is attached to the adapter body 118 by screws 120, and is formed with a T-shaped channel 125 defined by surfaces 122 and 124 configured to slidably receive the T block 108. The weight of the slide 106 is supported on surfaces 124 by the wings of the T block 108 before the adapter 102 forcibly engages the slide 106 after the slide 106 engages the driver 130 fixed to the lower platen 132 (FIG. 16A). The channel 125 is elongated to accommodate lateral movement of the slide 106.

Downwardly facing inclined cam surfaces 126 on the T guide 116 have wear plates 128 secured thereto with screws (not shown) abutting an inclined cam surface on the upper sloping surface 110 on the slide block 112 when the slide 106 is engaged by the driver 130.

An end face 134 of the slide block 112 is aligned with a facing surface 136 of the adapter body 118.

A single combination spring 138 is received in a bore 140 in the slide block 112 and is compressed against the surface 136 when the slide block 112 is advanced towards the surface 136. The combination spring 138 abuts a closure plug or a snap ring 142 adjacent the end of the bore 140 to allow compression thereof.

A variable spring rate is produced by the combination spring 138 as described in detail in copending U.S. application Ser. No. 10/936,213, filed on Sep. 7, 2004.

A retainer-stop plate 144 is secured to the stepped front face 148 of the T guide 116 with a screw 146 to keep the T block 108 within the T shaped channel 125.

The slide 106 is equipped with a tooling plate 150 to allow adjustment of the location of the tool T as described in U.S. application Ser. No. 11/027,494, filed on Dec. 30, 2004.

The driver 130 has a central locator-guide key 152 attached to a base 154 with screws 156 fixed to the press lower platen 132, aligned with a mating central slot 158 in the slide block 112.

A pair of wear plates 160 is attached to under surfaces 162 on the slide block 112 with screws (not shown). The surfaces 161 of the wear plates 160 engage aligned surfaces 164 on the driver base 154 on either side of the locator key 152.

Figure 16B:
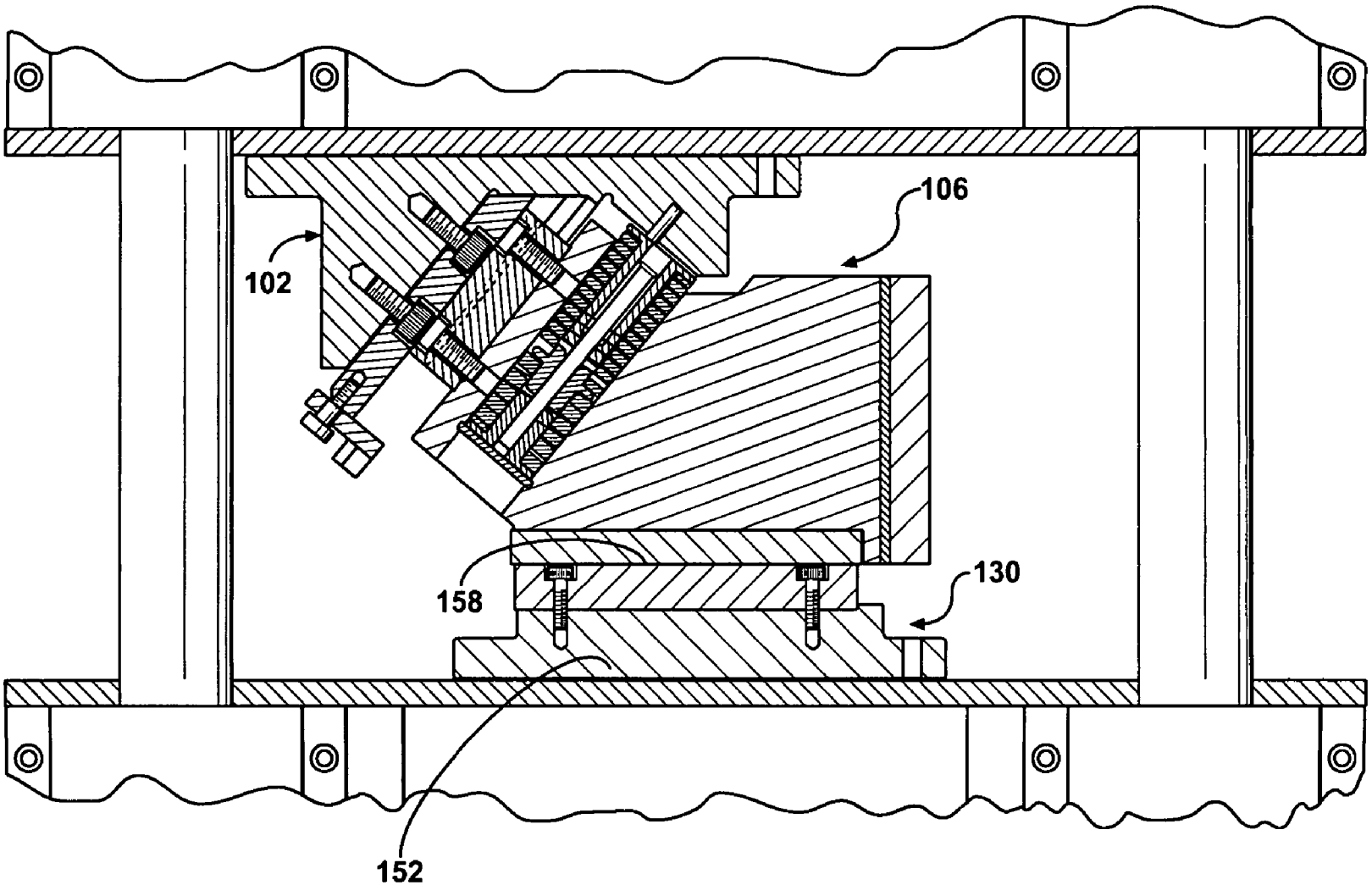
Figure 16C:
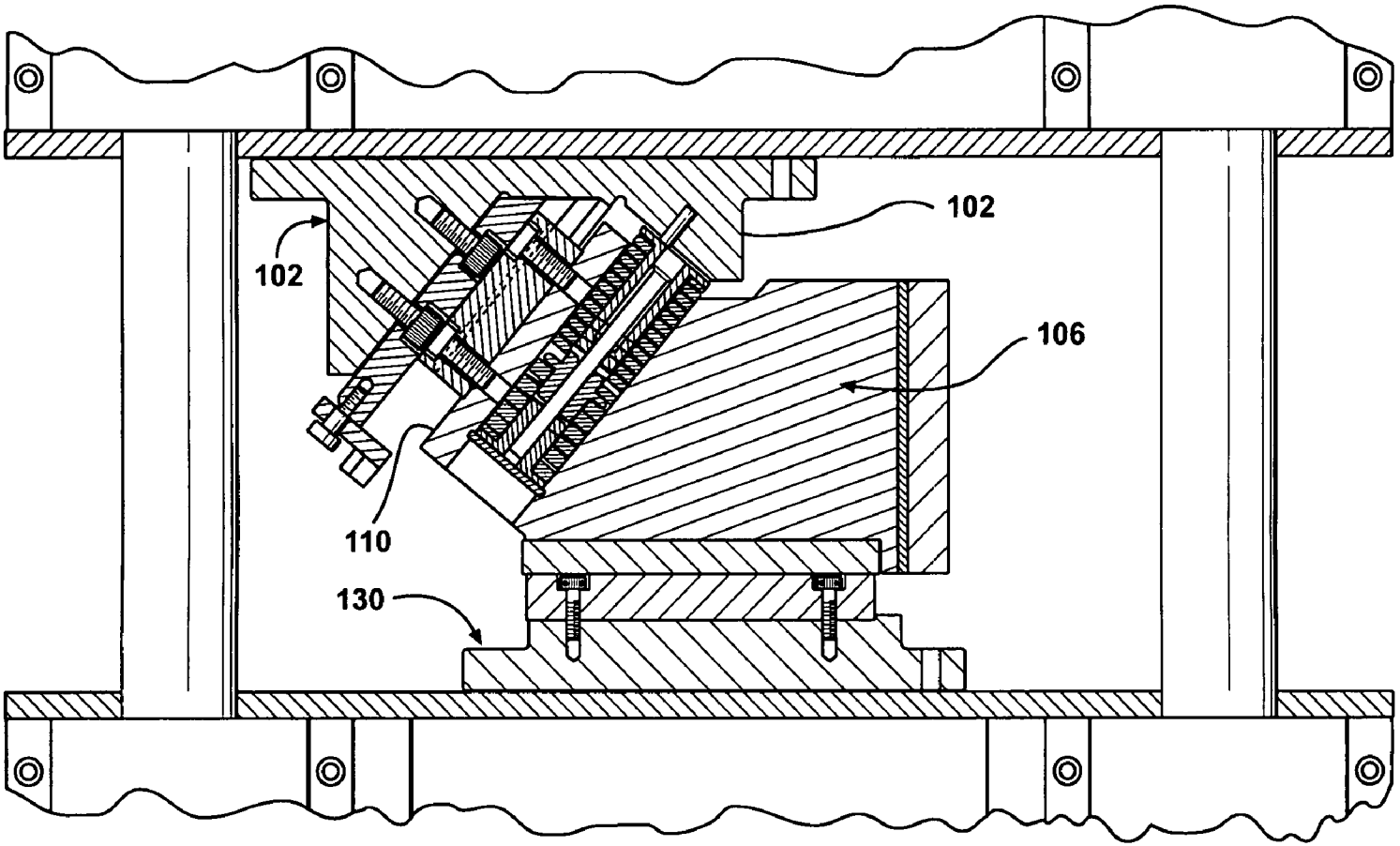
Figure 18:
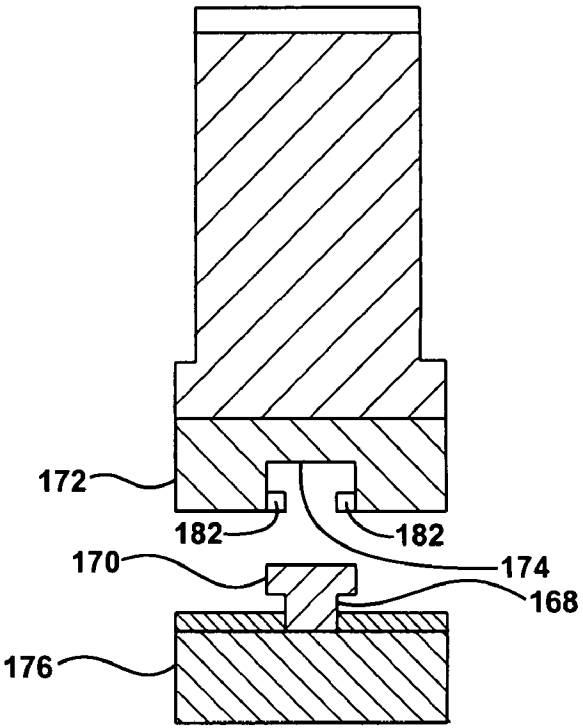
FIG. 18 is a fragmentary transverse sectional view through the cam shown in FIG. 17.
Figure 17:
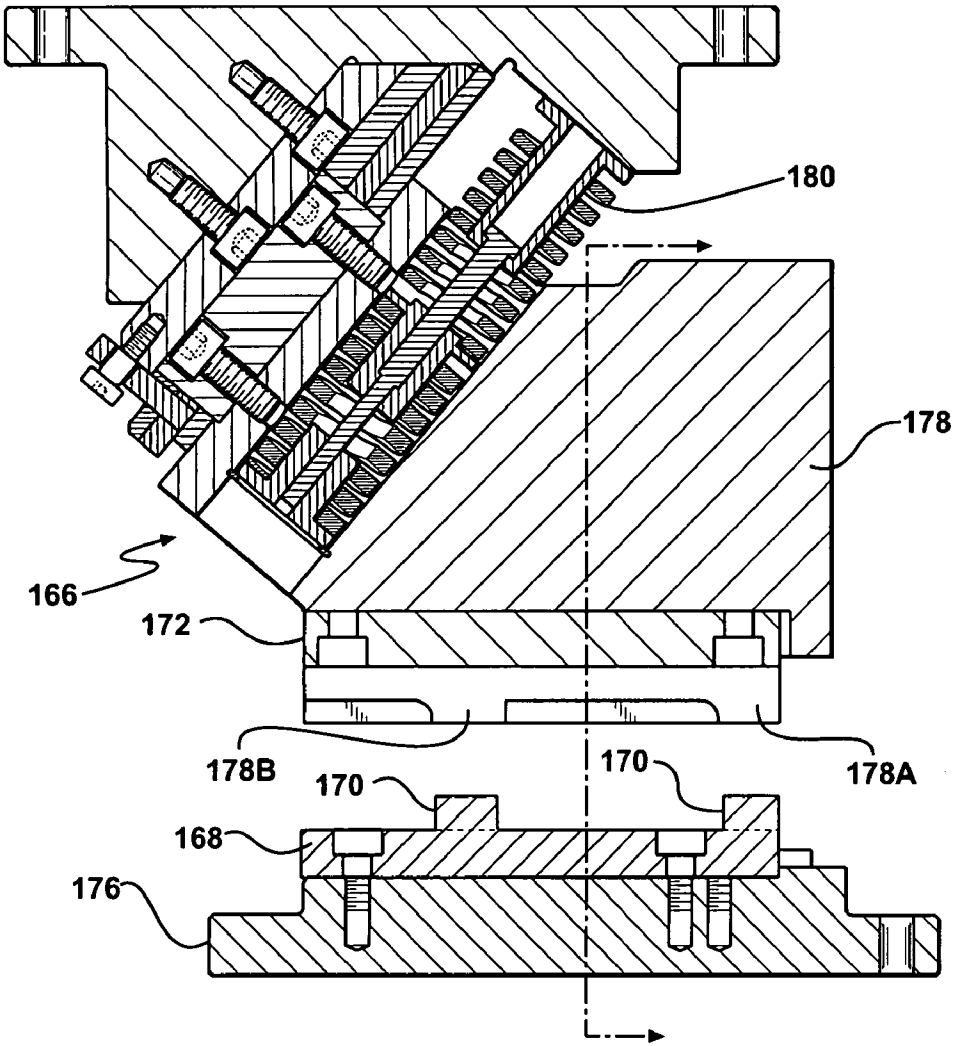
FIG. 17 is a partially sectional side elevational view of an aerial cam according to the invention having a positive retraction mechanism incorporated therein according to a further feature of the invention.
Figure 19:
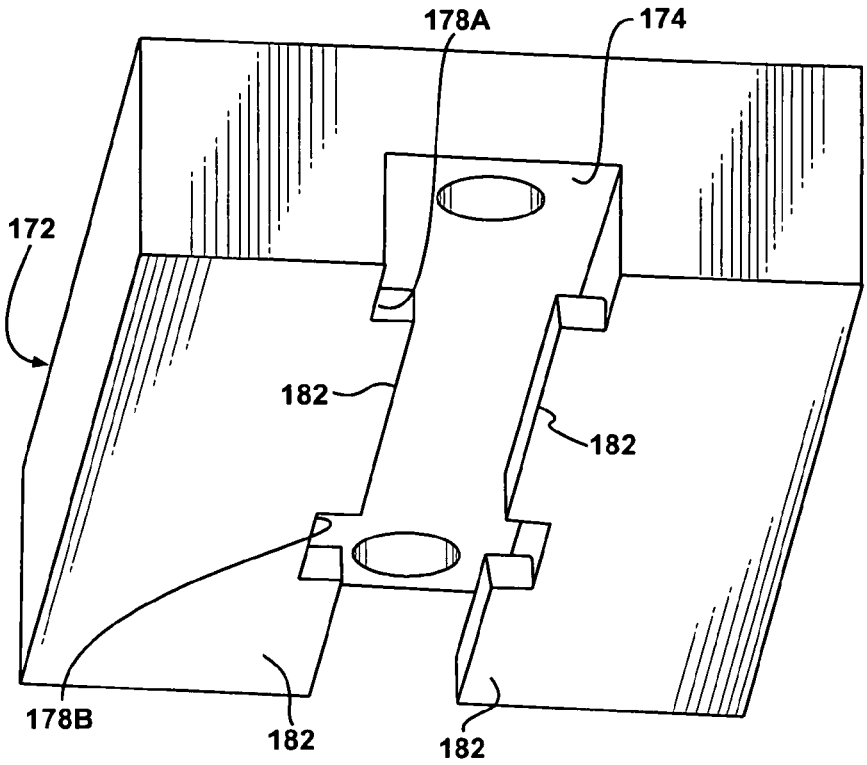
FIG. 19 is a pictorial view from below, of the channel block attached to the slide shown in FIGS. 17 and 18.
Figure 20:
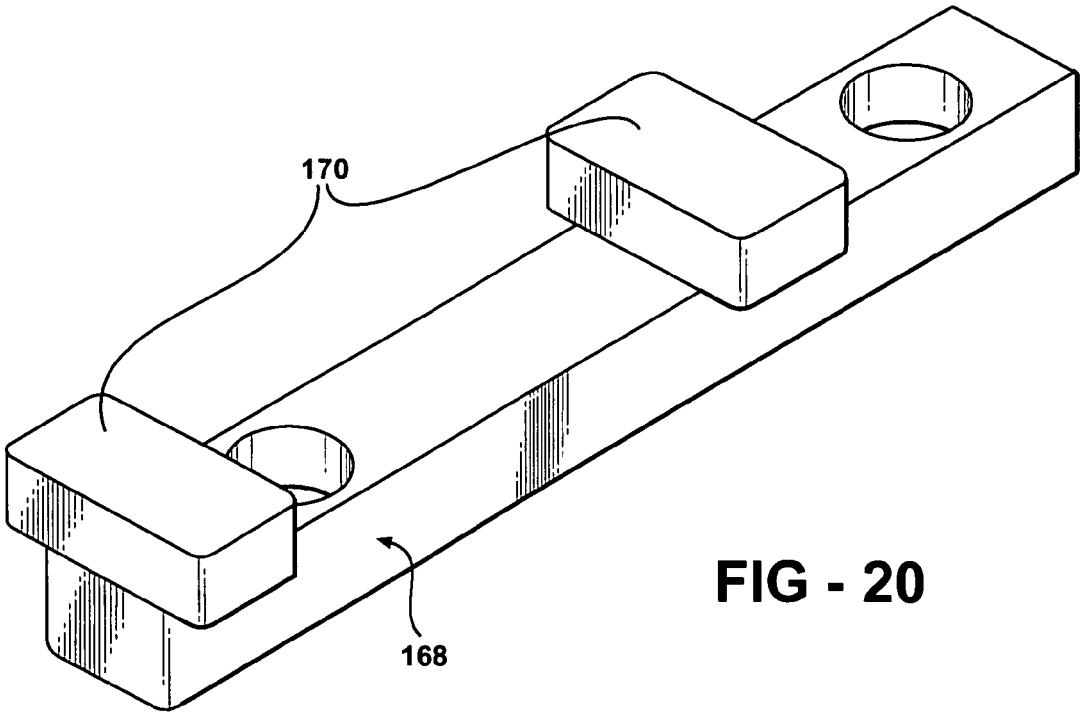
FIG. 20 is a pictorial view from above, of the key attached to the driver of the cam shown in FIGS. 17 and 18.
Figure 21:
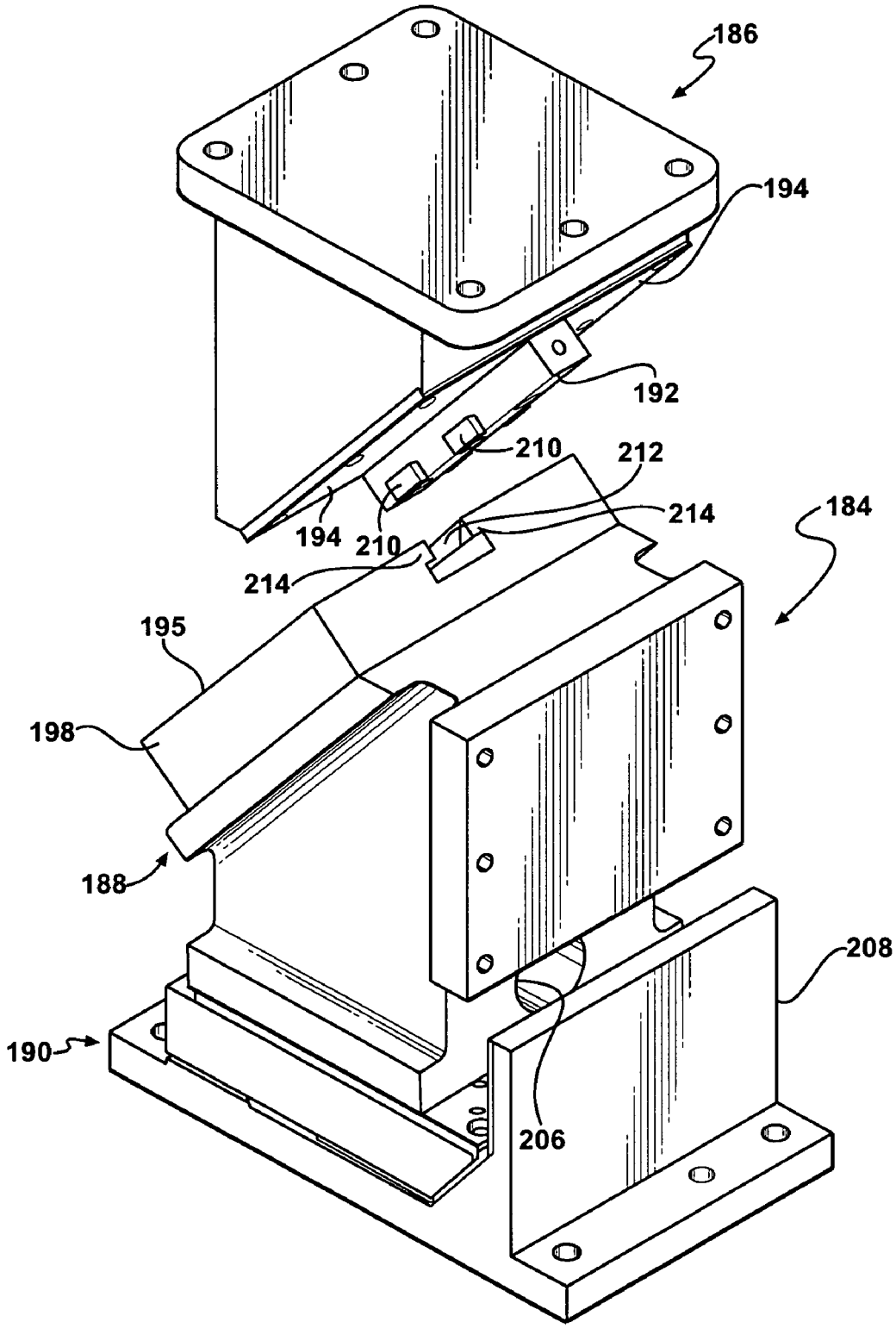
FIG. 21 is an exploded pictorial view of a die mounted cam according to the present invention.

Referring to FIGS. 16A, 16B and 16C, at the start of a cycle the upper platen 104 is elevated so that the slide 106 is spaced above the driver 130. The slide 106 is suspended on the adapter 102 such that a predetermined clearance space "A" exists between the top of the T-shaped channel 125 and top of the T block 108. The undersides of the T block 108 rests on the surfaces 124.

A predetermined clearance space "B" also exists between wear plates 128 and surfaces 110.

As the upper platen 104 is lowered, the locator-guide key 152 enters the slot 158 as seen in FIG. 16B, and the surface 164 and wear plates 160 engage.

The spaces A, B thus are eliminated, and the wings of the T block 108 lift off surfaces 124. Wear plates 128 engage surface 110 at the same time. The presence of the gaps A, B delays the forcible engagement between the wear plates 128 and surface 110 by the press motion, such that the momentum of the slider 106 is first absorbed by the driver 130 by engagement of the surfaces 162, 164, as in the above described embodiment.

Forcible engagement therebetween by the press is thus momentarily delayed. Thereafter, the camming action proceeds due to the engagement of the angled wear plates 128 and surface 110, driving the slide 106 horizontally fully to right as seen in FIG. 16C.

Thus, shock loading is reduced without the use of auxiliary rollers, etc. to reduce the manufacturing costs.

The locator-guide key 152 and guide T block 108 and T-shaped channel 125 are centrally located and thus easy to machine to reduce costs to achieve the objects of the invention.

Referring to FIGS. 17–20, a positive return interengagement between the driver 176 and slide 178 is shown in another embodiment of an aerial cam 116 according to the invention incorporated in the driver 176, slide 178, locator-guide key 168 and channel 174.

Figure 14:
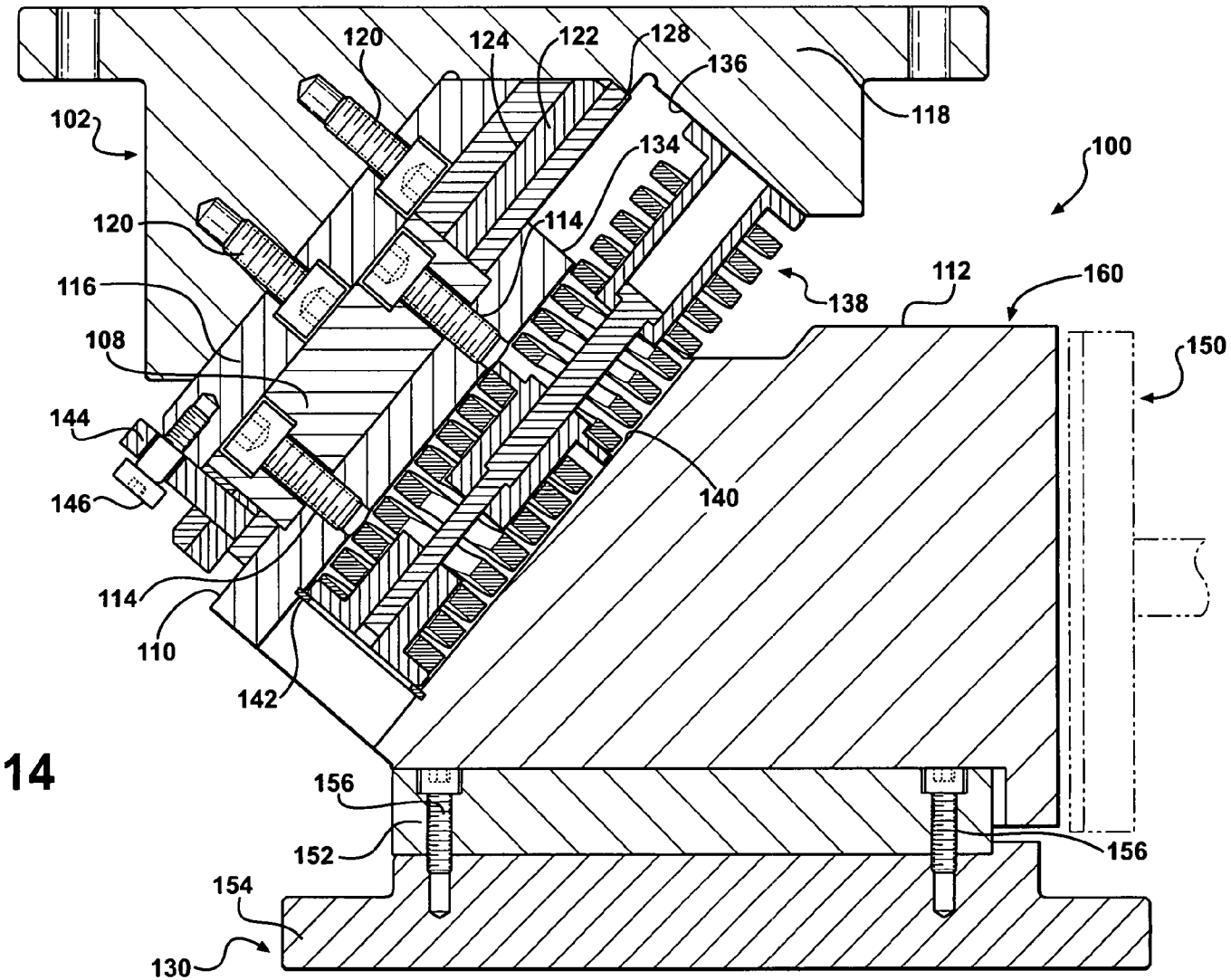
FIG. 14 is a view of a lengthwise section taken through the aerial cam shown in FIG. 12.
Figure 15:
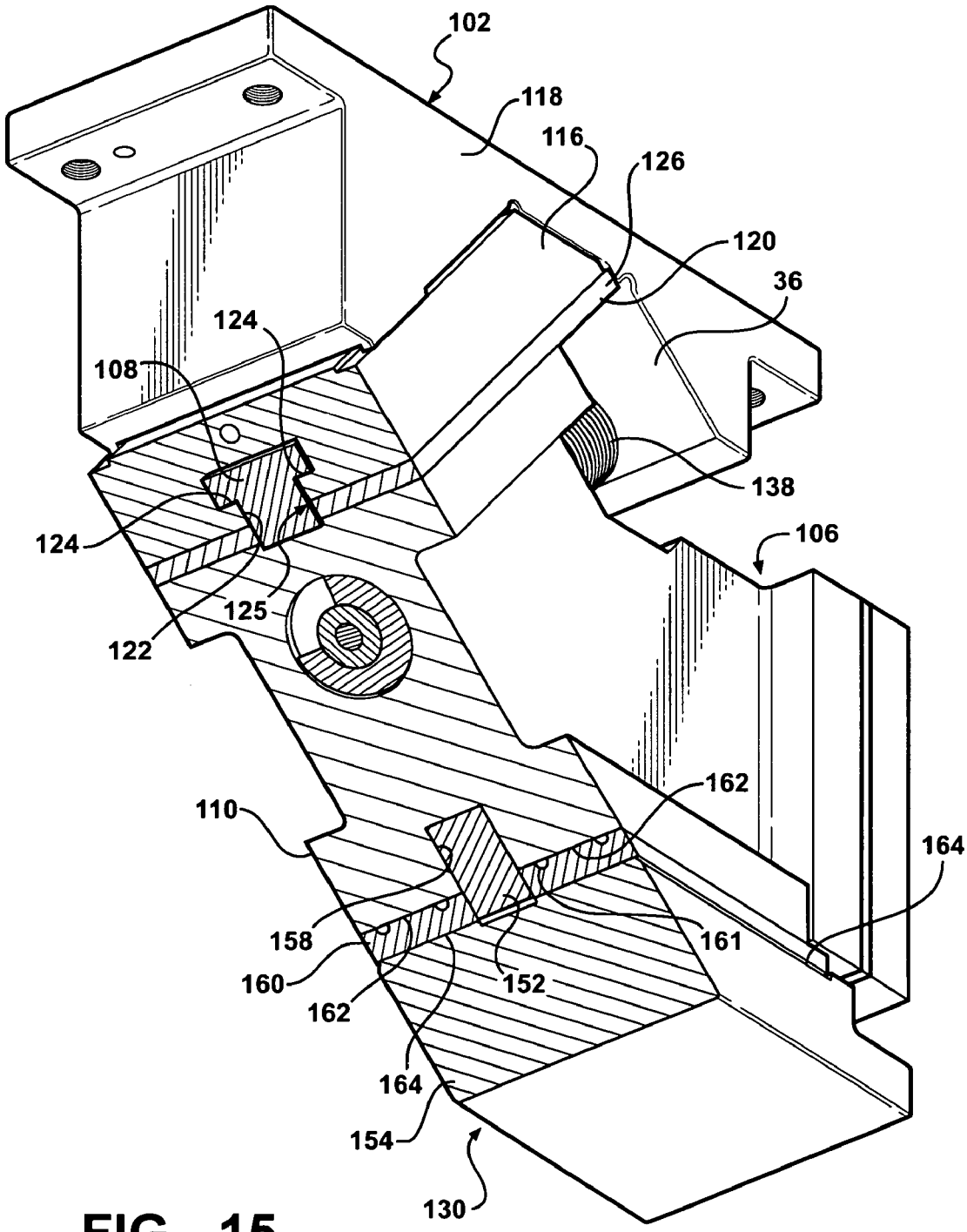
FIG. 15 is a view of the transversely sectioned aerial cam shown in FIGS. 12 and 13.

The aerial cam 166 is similar to the embodiment shown in FIGS. 14 and 15.

However, the locator-guide key 168 attached to the driver 176 has a pair of T heads 170 fixed thereto, creating a localized T block shape along the length thereof.

A channel block 172 affixed to the slide 178 is formed with a T-shaped channel 174 mating with locator-guide key 168.

A pair of openings 178A, 178B are aligned with the T heads 170 when the slide 178 is in the retracted position so that the T heads 170 can enter the channel 174 as the press is operated. The T heads 170 slide along the channel 174 as the driver 176 cams the slide 178 laterally as the press motion continues capturing the T heads 170 therein.

Upon retraction of the upper platen (not shown), if the compressed return spring 180 is not sufficiently strong to drive the slide 178 back to its start position, the T heads 170 forcibly engage the wings 182 of the channel 174, positively camming the slide 178 back to its start position. The openings 178A, 178B are then aligned with the T heads 170 and this allows separation of the driver 176 and slide 178, and continued upward movement of the slide 178.

The use of two spaced apart T heads 170 doubles the length of structure exerting the positive return forces over the bars previously used to greatly strengthens the mechanism and avoid serious damage when a tool is severely hung up.

A die mounted embodiment of a press mounted cam 184 according to the present invention is shown in FIGS. 21–25.

The die mounted cam 184 has the driver 186 mounted on an upper press platen or die part (not shown) above a slide 188 mounted to an adapter 190 mounted to a lower platen or die part (not shown).

A locator-guide key 192 is centrally affixed to the driver 186 of cam surfaces 194, aligned with a channel 196 defined in an angled cam plate 198 forming a part of slide 188.

The slide 188 is movably mounted on the adapter 190, guided by a centrally located T block 200 (FIG. 25) affixed to the bottom of the slide 188. A T shaped channel 202 formed in the adapter 190 guides lateral movement of the slide 188 on the adapter 190 on surfaces 191, 193.

A return spring 204 received in a cavity 206 engages an opposing plate 208 of the adapter 190 to be compressed as the slide 188 is cammed laterally by the driver 186.

The locator-guide key 192 has a pair of T heads 210A, 210B creating localized T shapes on the key 192.

Figure 22:
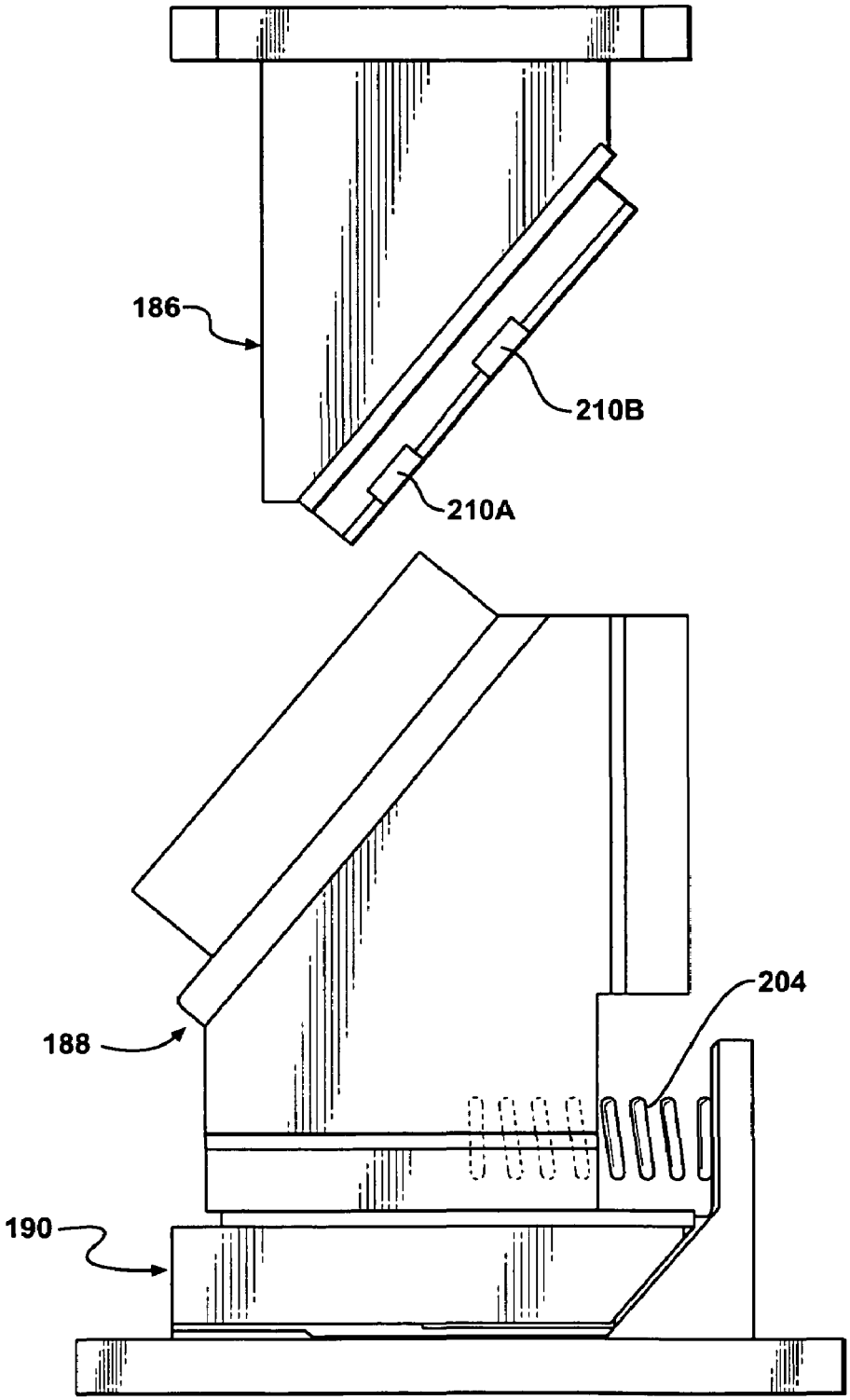
FIG. 22 is a side elevational view of the components of the cam shown in FIG. 21 prior to engagement of the driver with the slide.
Figure 23:
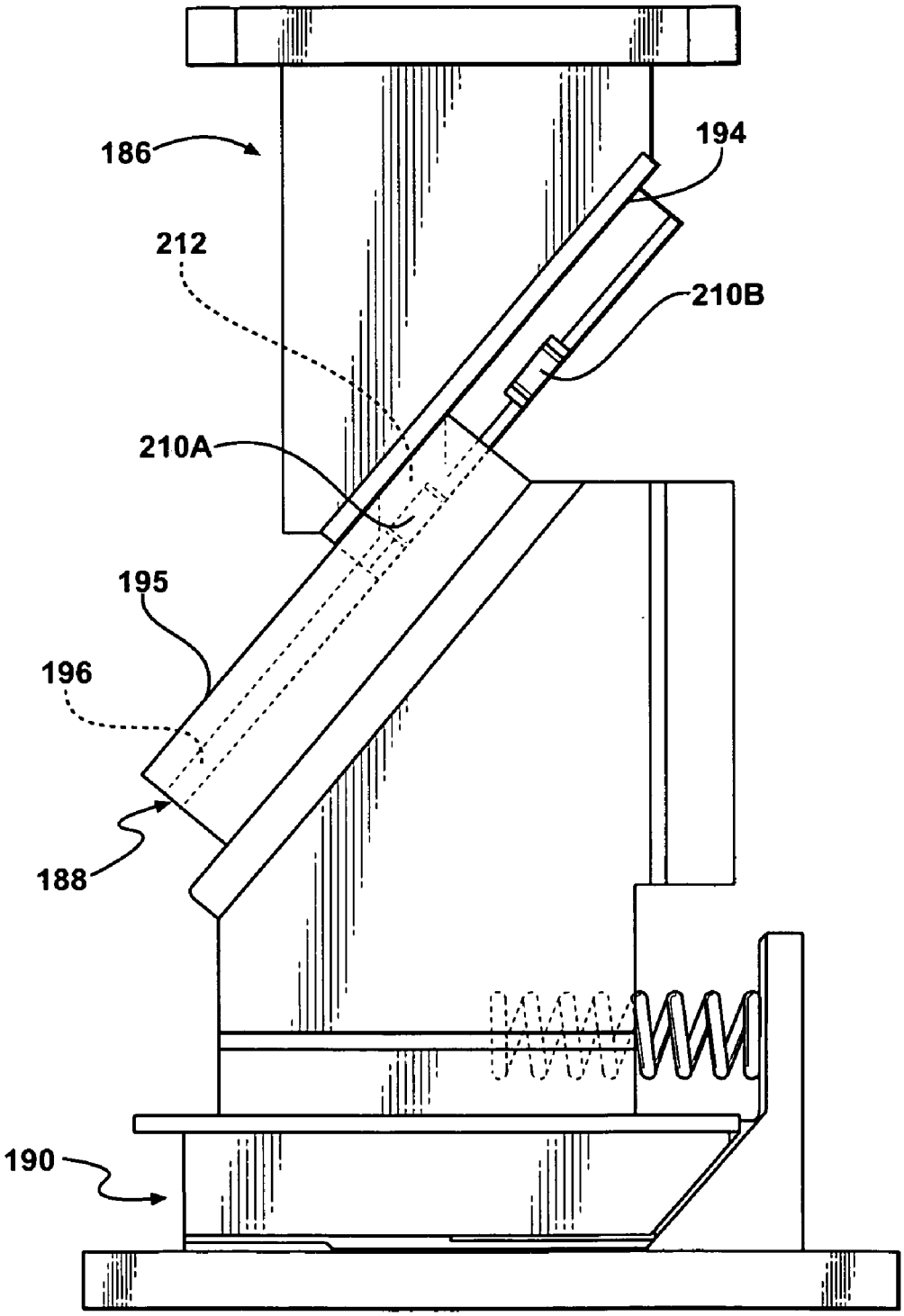
FIG. 23 is a side elevational view of the components of the cam shown in FIG. 22 with the driver in initial engagement with the slide.
Figure 24:
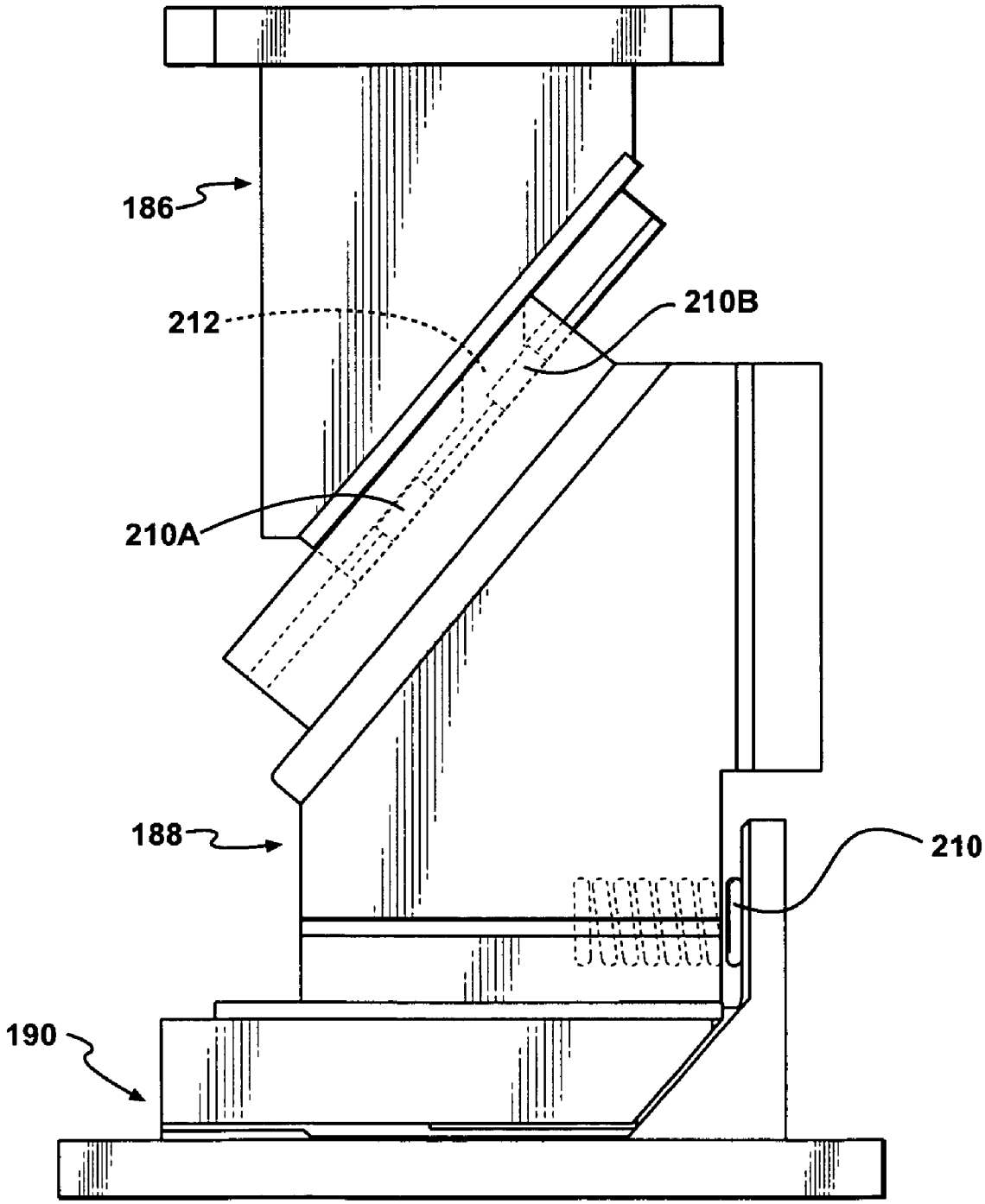
FIG. 24 is a side elevational view of the components of the cam shown in FIG. 23 with the driver fully descended.
Figure 25:
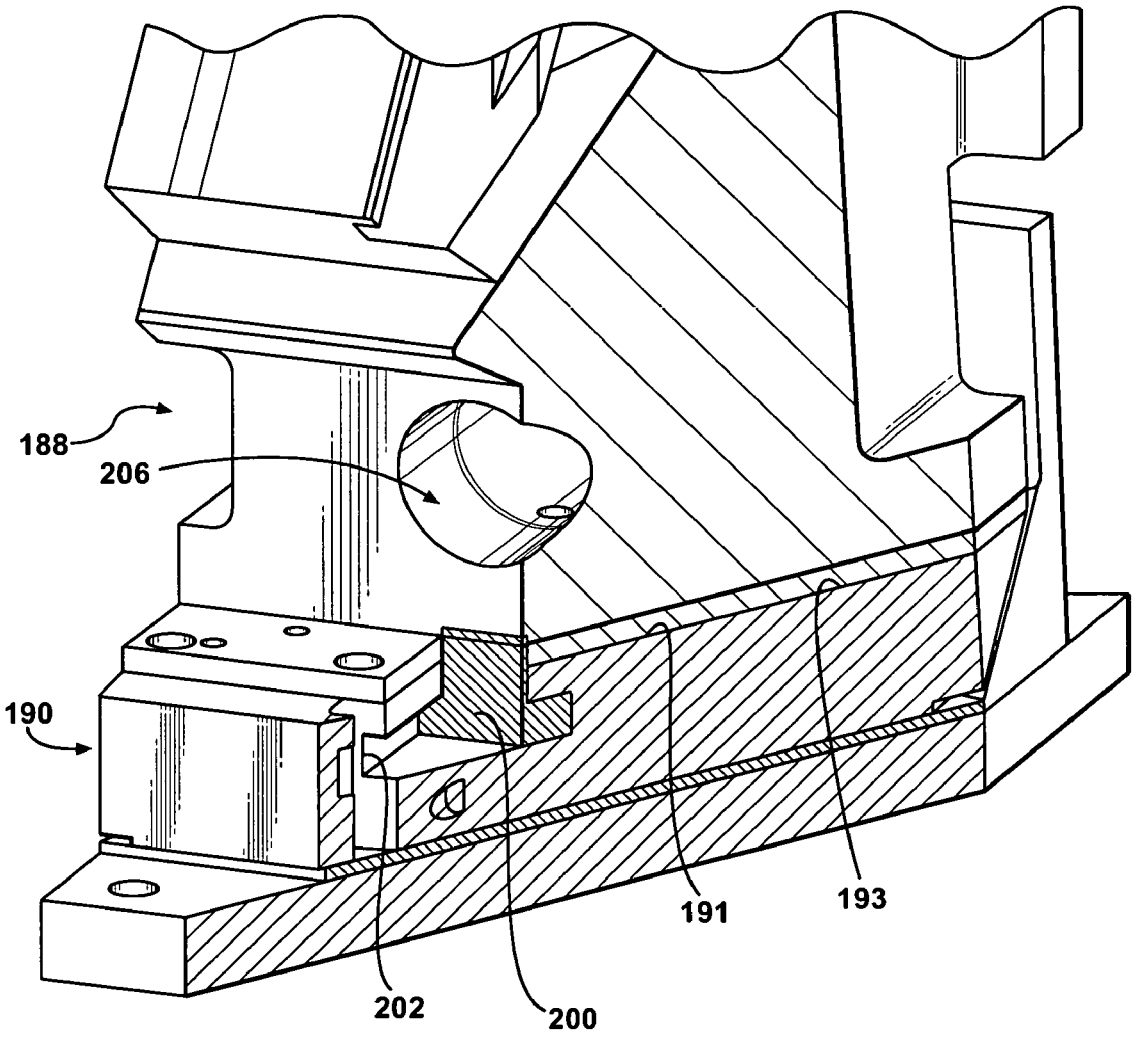
FIG. 25 is a fragmentary pictorial view of the portions of the adapter and slide in partial section.

A slot 212 interrupts the wings 214 of the channel at a point aligned with one of the T heads 210A, 210B with the slide 188 in a retracted start position as seen in FIG. 22.

As the driver 186 descends, the lead T head 210A passes through the slot 212 to enter the channel 196. The main body of the locator-guide key 192 locates on the sides of wings 214 of the channel 196 and guides the slide 188 laterally as the camming surfaces 194, 195 are engaged to drive the slide 188 to the left to the fully advanced position shown in FIG. 24.

Upon reversal, the T heads 210A, B engage the underside of the channel wings 214 to positively retract the slide 188 if the compressed return spring 206 is unable to do this.

Upon reaching the full retracted position of the slide 188, the slot 212 is again aligned with element 210A and the other element 210B clears the channel 196 to allow separation of the driver 186 from the slide 188.

The invention claimed is:

1. In an aerial cam adapted to be mounted in a forming press including: an adapter configured to be mounted to be movable with an upper press platen;

a slide mounted on said adapter by interfit structure to elements on said adapter and slide to suspend said slide on said adapter while allowing sliding movement thereon;

a driver adapted to be mounted on a lower press platen beneath said adapter and slide and aligned therewith to cause a surface on said driver to be engaged by a surface on said slide after continued downward movement of said upper platen;

one of said driver or said adapter having a sloping cam surface drivingly engaging a sloping cam surface on said slide upon continued descending movement of said upper platen and causing sliding movement of said slide on said driver and adapter to carry out a forming operation with tooling on said slide, the improvement comprising:

a clearance space between said adapter and said slide on said adapter which is taken up only after engagement of said driver and slide to create a momentary delay before positive engagement therebetween induced by said press to reduce shock and noise caused by positive driving engagement of said slide by the motion of said press upper platen.

2. The aerial cam according to claim 1 wherein said structural features comprise one or more T blocks fixed to said slide and extending down through a T-shaped channel in said adapter, and surfaces adjacent said channel engaging under surfaces of a head portion of said T block to suspend said slide on said adapter, said channel accommodating limited lateral motion of said T block therein, said clearance space being between said T block head portion and the surface adjacent the top of said channel.

3. The aerial cam according to claim 1 wherein said slide and the other of said adapter or driver have mating laterally extending guide surfaces engaged while said slide is undergoing sliding motion induced by said engagement of said mating sloping cam surfaces on said slide and one of said driver or said adapter and said downward motion of said press.

4. The aerial cam according to claim 1 further including an upwardly projecting locator-guide key affixed to said driver aligned with a slot formed in the bottom of said slide, said locator-guide key moving into said slot as said slide descends towards said driver prior to engagement of said cam surfaces.

5. The aerial cam according to claim 1 wherein said sloping cam surface is formed on said adapter.

6. The aerial cam according to claim 1 wherein said sloping cam surface is formed on said driver and comprises said surface first engaged by said surface on said slide.

7. In an aerial cam adapted to be mounted in a forming press including:

an adapter configured to be mounted to be movable with an upper press platen;

a slide mounted on said adapter by interfit structure to elements on said adapter and slide to suspend said slide on said adapter while allowing lateral movement thereon;

a driver adapted to be mounted on a lower press platen beneath said adapter and slide and aligned therewith to cause a surface on said driver to be engaged by a surface on said slide after continued downward movement of said upper platen;

one of said driver or said adapter having a sloping cam surface drivingly engaging a sloping cam surface on said slide upon continued descending movement of said upper platen and causing lateral movement of said slide on said driver and adapter to carry out a forming operation with tooling on said slide, the improvement comprising:

a clearance space between said structural features suspending said slide on said adapter which is taken up only after engagement of said driver and slide to create a momentary delay before positive engagement therebetween induced by said press to reduce shock and noise caused by positive driving engagement of said slide by the motion of said press upper platen;

wherein said structural features comprise one or more T blocks fixed to said slide and extending down through a T-shaped channel in said adapter, and surfaces adjacent said channel engaging under surfaces of a head portion of said T block to suspend said slide on said adapter, said channel accommodating limited lateral motion of said T block therein, said clearance space being between said T block head portion and the surface adjacent the top of said channel.

8. The aerial cam according to claim 7 wherein a pair of laterally spaced apart T blocks are fixed to said slide, and a pair of T-shaped slots in said adapter, each receiving a respective T block.

9. A press mounted cam comprising: an adapter mounted to be movable with a press platen;

a slide mounted on said adapter by interfit structural features on said adapter and slide to mount said slide on said adapter while allowing lateral movement thereon;

a driver adapted to be mounted on another press platen aligned with said adapter and slide;

one of said driver or said adapter having a sloping cam surface drivingly engaging a sloping cam surface on said slide upon continued descending movement of said upper platen and causing lateral movement of said slide on said driver and adapter to carry out a forming process with tooling on said slide, the improvement comprising:

said interfit structural features including a T block fixed to said slide and extending into a T-shaped channel in said adapter, and surfaces defining said channel engaging said T block to guide said slide on said adapter.

10. The cam according to claim 9 wherein said slide is suspended on said adapter movable with an upper press platen and said T-shaped channel accommodates limited lateral motion of said T block therein.

11. The cam according to claim 9 wherein said slide and the other of said adapter or driver have mating laterally extending guide surfaces engaged while said slide is undergoing lateral motion induced by said engagement of said mating sloping cam surfaces on said slider and one of said driver or said adapter and said downward motion of an upper platen of said press.

12. The cam according to claim 10 further including a projecting locator-guide key affixed to said driver aligned with a channel formed in a facing side of said slide, said locator-guide key moving into said channel as said slide descends towards said driver prior to engagement of said cam surfaces.

13. The cam according to claim 12 wherein said locator key has one or more T heads attached and said slide channel is T-shaped with one or more spaces aligned before said slide is driven laterally allowing entrance of said one or more T heads which are subsequently captured by lateral motion of said slide, whereby a positive return of said slide is produced by retraction of said upper platen of said press.

14. A press mounted cam comprising:

an adapter mounted to be movable with a press platen;

a slide mounted on said adapter by interfit structural features on said adapter and slide to mount said slide on said adapter while allowing lateral movement thereon;

a driver adapted to be mounted on another press platen aligned with said adapter and slide;

one of said driver or said adapter having a sloping cam surface drivingly engaging a sloping cam surface on said slide upon continued descending movement of said upper platen and causing lateral movement of said slide on said driver and adapter to carry out a forming process with tooling on said slide, the improvement comprising:

a pair of spaced apart T blocks fixed to said driver and a T-shaped channel formed into a surface of said slide facing said driver, said T-shaped channel aligned with said one or more T blocks;

said channel having wing and flanges forming said T-shape having one or more slots therein aligned with one or more of said T blocks in a retracted position of said slide to allow said one or more T blocks to pass into said channel, said one or more slots becoming misaligned with said one or more T blocks upon advance of said slide whereby said one or more T blocks engages the undersurface of said wing flanges to positively retract said slide upon retraction of said driver.

15. The cam according to claim 14 wherein a pair of spaced apart T blocks are on said driver.

16. In an aerial cam including an adapter mounted to a press upper platen, a slider suspended from said adapter so as to allow limited lateral motion, a driver mounted on a lower press platen beneath said slider to be aligned therewith so as to have a surface to be engaged with a surface on said slider upon continued downward motion of said press upper platen, the slider and driver or adapter having mating cam surfaces engaged by said press motion to drive said slider laterally along the direction of a working angle, a method of reducing shock loading when said mating surface said slide and driver are initially engaged, comprising: forming a clearance space between said adapter and slide momentarily delaying positive engagement of said mating surface on said driver until said clearance space is eliminated by descending motion of said upper platen, whereby momentum of said slide is absorbed prior to positive driving of said slide laterally by press motion.

* * * * *